US011565148B2

(12) United States Patent
Dalebout et al.

(10) Patent No.: US 11,565,148 B2
(45) **Date of Patent: *Jan. 31, 2023**

(54) TREADMILL WITH A SCALE MECHANISM IN A MOTOR COVER

(71) Applicant: iFIT Inc., Logan, UT (US)

(72) Inventors: William T. Dalebout, North Logan, UT (US); Gordon Cutler, Providence, UT (US)

(73) Assignee: iFIT Inc., Logan, UT (US)

( * ) Notice: Subject to any disclaimer, the term of this patent is extended or adjusted under 35 U.S.C. 154(b) by 295 days.

This patent is subject to a terminal disclaimer.

(21) Appl. No.: 16/790,867

(22) Filed: Feb. 14, 2020

(65) Prior Publication Data

US 2020/0222751 A1 Jul. 16, 2020

Related U.S. Application Data

(63) Continuation of application No. 15/461,271, filed on Mar. 16, 2017, now Pat. No. 10,561,894.
(Continued)

(51) Int. Cl.
*A63B 22/02* (2006.01)
*A63B 21/072* (2006.01)
(Continued)

(52) U.S. Cl.
CPC ..... *A63B 22/0285* (2013.01); *A63B 21/072* (2013.01); *A63B 21/0726* (2013.01);
(Continued)

(58) Field of Classification Search
CPC ..... A63B 21/072; A63B 21/0724; A63B 21/0726; A63B 21/075; A63B 21/22;
(Continued)

(56) References Cited

U.S. PATENT DOCUMENTS 1,919,627 A 7/1933 Fitz
2,017,885 A 10/1935 Atcheson
(Continued)

FOREIGN PATENT DOCUMENTS

CN 203989681 12/2014
KR 100829774 5/2008
(Continued)

OTHER PUBLICATIONS

U.S. Appl. No. 13/088,007, filed Apr. 15, 2011, Scott R. Watterson.
(Continued)

*Primary Examiner* — Gary D Urbiel Goldner
(74) *Attorney, Agent, or Firm* — Ray Quinney & Nebeker P.C.; Paul N. Taylor

(57) ABSTRACT

A treadmill includes a platform where the platform includes a first side panel and a second side panel spaced apart at a distance from the first side panel, and a gap defined between the first side panel and the second side panel. The treadmill also includes a running deck contained within the platform and exposed within the gap, a first pulley connected to the running deck, a second pulley connected to the running deck opposite the first pulley, a tread belt surrounding the first pulley and the second pulley. A motor is in mechanical communication with at least one of the first pulley or the second pulley. A cover is located over the motor. A scale mechanism is incorporated into the cover over the motor.

19 Claims, 12 Drawing Sheets

Related U.S. Application Data

(60) Provisional application No. 62/310,279, filed on Mar. 18, 2016.

(51) Int. Cl.

| | |
|---|---|
| ***A63B 71/00*** | (2006.01) |
| ***A63B 24/00*** | (2006.01) |
| ***A63B 69/00*** | (2006.01) |
| ***A63B 71/06*** | (2006.01) |
| ***A63B 21/22*** | (2006.01) |
| ***A63B 22/00*** | (2006.01) |
| ***A63B 21/075*** | (2006.01) |
| ***A63B 22/06*** | (2006.01) |

(52) U.S. Cl.

CPC ..... *A63B 22/0235* (2013.01); *A63B 22/0242* (2013.01); *A63B 24/0087* (2013.01); *A63B 69/0057* (2013.01); *A63B 71/0036* (2013.01); *A63B 71/0622* (2013.01); *A63B 21/075* (2013.01); *A63B 21/0724* (2013.01); *A63B 21/225* (2013.01); *A63B 22/0023* (2013.01); *A63B 22/0048* (2013.01); *A63B 22/0076* (2013.01); *A63B 22/0605* (2013.01); *A63B 22/0664* (2013.01); *A63B 2024/0093* (2013.01); *A63B 2071/063* (2013.01); *A63B 2071/065* (2013.01); *A63B 2071/0625* (2013.01); *A63B 2071/0658* (2013.01); *A63B 2220/17* (2013.01); *A63B 2220/20* (2013.01); *A63B 2220/30* (2013.01); *A63B 2220/51* (2013.01); *A63B 2220/52* (2013.01); *A63B 2220/58* (2013.01); *A63B 2220/805* (2013.01); *A63B 2220/807* (2013.01); *A63B 2225/20* (2013.01); *A63B 2225/50* (2013.01); *A63B 2225/68* (2013.01); *A63B 2225/74* (2020.08); *A63B 2230/01* (2013.01); *A63B 2230/06* (2013.01); *A63B 2230/062* (2013.01)

(58) Field of Classification Search

CPC ..... A63B 21/225; A63B 21/4023; A63B 21/4027; A63B 21/4043; A63B 22/02; A63B 22/0235; A63B 22/0242; A63B 22/0257; A63B 24/0062; A63B 24/0075; A63B 24/0087; A63B 2024/0068; A63B 2024/0093; A63B 71/0036; A63B 71/0619; A63B 71/0622; A63B 71/0669; A63B 2071/0625; A63B 2071/063; A63B 2071/065; A63B 2071/0658; A63B 2220/17; A63B 2220/50; A63B 2220/51; A63B 2220/52; A63B 2220/58; A63B 2220/80; A63B 2220/83; A63B 2220/833; A63B 2230/01; A63B 2230/015

See application file for complete search history.

(56) References Cited

U.S. PATENT DOCUMENTS

| | | | |
|---|---|---|---|
| 2,155,684 | A | 4/1939 | Richards |
| 3,123,646 | A | 3/1964 | Easton |
| 3,579,339 | A | 5/1971 | Chang |
| 3,870,297 | A | 3/1975 | Elder |
| 4,023,795 | A | 5/1977 | Pauls |
| 4,300,760 | A | 11/1981 | Bobroff |
| 4,413,821 | A | 11/1983 | Centafanti |
| D286,311 | S | 10/1986 | Martinell |
| 4,681,318 | A | 7/1987 | Lay |
| 4,684,126 | A | 8/1987 | Dalebout |
| 4,705,028 | A | 11/1987 | Melby |
| 4,725,057 | A | 2/1988 | Shiffferaw |
| 4,728,102 | A | 3/1988 | Pauls |
| 4,750,736 | A | 6/1988 | Watterson |
| 4,796,881 | A | 1/1989 | Watterson |
| 4,813,667 | A | 3/1989 | Watterson |
| 4,830,371 | A | 5/1989 | Lay |
| 4,844,451 | A | 7/1989 | Bersonnet |
| 4,850,585 | A | 7/1989 | Dalebout |
| D304,849 | S | 11/1989 | Watterson |
| 4,880,225 | A | 11/1989 | Lucas |
| 4,883,272 | A | 11/1989 | Lay |
| D306,468 | S | 3/1990 | Watterson |
| D306,891 | S | 3/1990 | Watterson |
| 4,913,396 | A | 4/1990 | Dalebout |
| D307,614 | S | 5/1990 | Bingham |
| D307,615 | S | 5/1990 | Bingham |
| 4,921,242 | A | 5/1990 | Watterson |
| 4,932,650 | A | 6/1990 | Bingham |
| D309,167 | S | 7/1990 | Griffin |
| D309,485 | S | 7/1990 | Bingham |
| 4,938,478 | A | 7/1990 | Lay |
| D310,253 | S | 8/1990 | Bersonnet |
| 4,955,599 | A | 9/1990 | Bersonnet |
| 4,971,316 | A | 11/1990 | Dalebout |
| D313,055 | S | 12/1990 | Watterson |
| 4,974,832 | A | 12/1990 | Dalebout |
| 4,979,737 | A | 12/1990 | Kock |
| 4,981,294 | A | 1/1991 | Dalebout |
| D315,765 | S | 3/1991 | Measom |
| 4,998,725 | A | 3/1991 | Watterson |
| 5,000,442 | A | 3/1991 | Dalebout |
| 5,000,443 | A | 3/1991 | Dalebout |
| 5,000,444 | A | 3/1991 | Dalebout |
| D316,124 | S | 4/1991 | Dalebout |
| 5,013,033 | A | 5/1991 | Watterson |
| 5,014,980 | A | 5/1991 | Bersonnet |
| 5,016,871 | A | 5/1991 | Dalebout |
| D318,085 | S | 7/1991 | Jacobson |
| D318,086 | S | 7/1991 | Bingham |
| D318,699 | S | 7/1991 | Jacobson |
| 5,029,801 | A | 7/1991 | Dalebout |
| 5,034,576 | A | 7/1991 | Dalebout |
| 5,058,881 | A | 10/1991 | Measom |
| 5,058,882 | A | 10/1991 | Dalebout |
| D321,388 | S | 11/1991 | Dalebout |
| 5,062,626 | A | 11/1991 | Dalebout |
| 5,062,627 | A | 11/1991 | Bingham |
| 5,062,632 | A | 11/1991 | Dalebout |
| 5,062,633 | A | 11/1991 | Engel |
| 5,067,710 | A | 11/1991 | Watterson |
| 5,072,929 | A | 12/1991 | Peterson |
| D323,009 | S | 1/1992 | Dalebout |
| D323,198 | S | 1/1992 | Dalebout |
| D323,199 | S | 1/1992 | Dalebout |
| D323,863 | S | 2/1992 | Watterson |
| 5,088,729 | A | 2/1992 | Dalebout |
| 5,090,694 | A | 2/1992 | Pauls |
| 5,102,380 | A | 4/1992 | Jacobson |
| 5,104,120 | A | 4/1992 | Watterson |
| 5,108,093 | A | 4/1992 | Watterson |
| D326,491 | S | 5/1992 | Dalebout |
| 5,122,105 | A | 6/1992 | Engel |
| 5,135,216 | A | 8/1992 | Bingham |
| 5,135,458 | A | 8/1992 | Huang |
| 5,147,265 | A | 9/1992 | Pauls |
| 5,149,084 | A | 9/1992 | Dalebout |
| 5,149,312 | A | 9/1992 | Croft et al. |
| 5,158,520 | A | 10/1992 | Lemke |
| 5,171,196 | A | 12/1992 | Lynch |
| D332,347 | S | 1/1993 | Raadt |
| 5,190,505 | A | 3/1993 | Dalebout |
| 5,192,255 | A | 3/1993 | Dalebout |
| 5,195,937 | A | 3/1993 | Engel |
| 5,203,826 | A | 4/1993 | Dalebout |
| D335,511 | S | 5/1993 | Engel |
| D335,905 | S | 5/1993 | Cutter |
| D336,498 | S | 6/1993 | Engel |
| 5,217,487 | A | 6/1993 | Engel |
| D337,361 | S | 7/1993 | Engel |
| D337,666 | S | 7/1993 | Peterson |

(56) References Cited

U.S. PATENT DOCUMENTS

| | | | |
|---|---|---|---|
| D337,799 | S | 7/1993 | Cutter |
| 5,226,866 | A | 7/1993 | Engel |
| 5,242,339 | A | 9/1993 | Thornton |
| 5,244,446 | A | 9/1993 | Engel |
| 5,247,853 | A | 9/1993 | Dalebout |
| 5,259,611 | A | 11/1993 | Dalebout |
| D342,106 | S | 12/1993 | Campbell |
| 5,279,528 | A | 1/1994 | Dalebout |
| D344,112 | S | 2/1994 | Smith |
| D344,557 | S | 2/1994 | Ashby |
| 5,282,776 | A | 2/1994 | Dalebout |
| 5,295,931 | A | 3/1994 | Dreibelbis |
| 5,302,161 | A | 4/1994 | Loubert |
| D347,251 | S | 5/1994 | Dreibelbis |
| 5,316,534 | A | 5/1994 | Dalebout |
| D348,493 | S | 7/1994 | Ashby |
| D348,494 | S | 7/1994 | Ashby |
| 5,328,164 | A | 7/1994 | Soga |
| D349,931 | S | 8/1994 | Bostic |
| 5,336,142 | A | 8/1994 | Dalebout |
| 5,344,376 | A | 9/1994 | Bostic |
| D351,202 | S | 10/1994 | Bingham |
| D351,435 | S | 10/1994 | Peterson |
| D351,633 | S | 10/1994 | Bingham |
| D352,534 | S | 11/1994 | Dreibelbis |
| D353,422 | S | 12/1994 | Bostic |
| 5,372,559 | A | 12/1994 | Dalebout |
| 5,374,228 | A | 12/1994 | Buisman |
| 5,382,221 | A | 1/1995 | Hsu |
| 5,385,520 | A | 1/1995 | Lepine |
| 5,387,168 | A | 2/1995 | Bostic |
| 5,393,690 | A | 2/1995 | Fu |
| D356,128 | S | 3/1995 | Smith |
| 5,409,435 | A | 4/1995 | Daniels |
| 5,429,563 | A | 7/1995 | Engel |
| 5,431,612 | A | 7/1995 | Holden |
| D360,915 | S | 8/1995 | Bostic |
| 5,468,205 | A | 11/1995 | McFall |
| 5,489,249 | A | 2/1996 | Brewer |
| 5,492,517 | A | 2/1996 | Bostic |
| D367,689 | S | 3/1996 | Wilkinson |
| 5,511,740 | A | 4/1996 | Loubert |
| 5,512,025 | A | 4/1996 | Dalebout |
| D370,949 | S | 6/1996 | Furner |
| D371,176 | S | 6/1996 | Furner |
| 5,527,245 | A | 6/1996 | Dalebout |
| 5,529,553 | A | 6/1996 | Finlayson |
| 5,540,429 | A | 7/1996 | Dalebout |
| 5,549,533 | A | 8/1996 | Olson |
| 5,554,085 | A | 9/1996 | Dalebout |
| 5,569,128 | A | 10/1996 | Dalebout |
| 5,591,105 | A | 1/1997 | Dalebout |
| 5,591,106 | A | 1/1997 | Dalebout |
| 5,595,556 | A | 1/1997 | Dalebout |
| 5,607,375 | A | 3/1997 | Dalebout |
| 5,611,539 | A | 3/1997 | Watterson |
| 5,622,527 | A | 4/1997 | Watterson |
| 5,626,538 | A | 5/1997 | Dalebout |
| 5,626,540 | A | 5/1997 | Hall |
| 5,626,542 | A | 5/1997 | Dalebout |
| D380,024 | S | 6/1997 | Novak |
| 5,637,059 | A | 6/1997 | Dalebout |
| D380,509 | S | 7/1997 | Wilkinson |
| 5,643,153 | A | 7/1997 | Nylen |
| 5,645,509 | A | 7/1997 | Brewer |
| D384,118 | S | 9/1997 | Deblauw |
| 5,662,557 | A | 9/1997 | Watterson |
| 5,667,461 | A | 9/1997 | Hall |
| 5,669,857 | A | 9/1997 | Watterson |
| 5,672,140 | A | 9/1997 | Watterson |
| 5,674,156 | A | 10/1997 | Watterson |
| 5,674,453 | A | 10/1997 | Watterson |
| 5,676,624 | A | 10/1997 | Watterson |
| 5,683,331 | A | 11/1997 | Dalebout |
| 5,683,332 | A | 11/1997 | Watterson |
| D387,825 | S | 12/1997 | Fleck |
| 5,695,433 | A | 12/1997 | Buisman |
| 5,695,434 | A | 12/1997 | Dalebout |
| 5,695,435 | A | 12/1997 | Dalebout |
| 5,702,325 | A | 12/1997 | Watterson |
| 5,704,879 | A | 1/1998 | Watterson |
| 5,718,657 | A | 2/1998 | Dalebout et al. |
| 5,720,200 | A | 2/1998 | Anderson |
| 5,720,698 | A | 2/1998 | Dalebout |
| D392,006 | S | 3/1998 | Dalebout |
| 5,722,922 | A | 3/1998 | Watterson |
| 5,733,229 | A | 3/1998 | Dalebout |
| 5,743,833 | A | 4/1998 | Watterson |
| 5,762,584 | A | 6/1998 | Daniels |
| 5,762,587 | A | 6/1998 | Dalebout |
| 5,772,560 | A | 6/1998 | Watterson |
| 5,810,698 | A | 9/1998 | Hullett |
| 5,827,155 | A | 10/1998 | Jensen |
| 5,830,114 | A | 11/1998 | Halfen |
| 5,860,893 | A | 1/1999 | Watterson |
| 5,860,894 | A | 1/1999 | Dalebout |
| 5,899,834 | A | 5/1999 | Dalebout |
| 5,921,892 | A | 7/1999 | Essi-Ferno |
| D412,953 | S | 8/1999 | Armstrong |
| D413,948 | S | 9/1999 | Dalebout |
| 5,951,441 | A | 9/1999 | Dalebout |
| 5,951,448 | A | 9/1999 | Bolland |
| D416,596 | S | 11/1999 | Armstrong |
| 6,003,166 | A | 12/1999 | Hald |
| 6,019,710 | A | 2/2000 | Dalebout |
| 6,027,429 | A | 2/2000 | Daniels |
| 6,030,320 | A | 2/2000 | Steams |
| 6,033,347 | A | 3/2000 | Dalebout et al. |
| 6,042,516 | A | 3/2000 | Norton |
| D425,940 | S | 5/2000 | Halfen |
| 6,059,692 | A | 5/2000 | Hickman |
| D428,949 | S | 8/2000 | Simonson |
| 6,113,519 | A | 9/2000 | Goto |
| 6,123,646 | A | 9/2000 | Colassi |
| 6,171,217 | B1 | 1/2001 | Cutler |
| 6,171,219 | B1 | 1/2001 | Simonson |
| 6,174,267 | B1 | 1/2001 | Dalebout |
| 6,193,631 | B1 | 2/2001 | Hickman |
| 6,228,003 | B1 | 5/2001 | Hald |
| 6,238,323 | B1 | 5/2001 | Simonson |
| 6,251,052 | B1 | 6/2001 | Simonson |
| 6,261,022 | B1 | 7/2001 | Dalebout et al. |
| 6,280,362 | B1 | 8/2001 | Dalebout et al. |
| 6,296,594 | B1 | 10/2001 | Simonson |
| D450,872 | S | 11/2001 | Dalebout |
| 6,312,363 | B1 | 11/2001 | Watterson |
| D452,338 | S | 12/2001 | Dalebout |
| D453,543 | S | 2/2002 | Cutler |
| D453,948 | S | 2/2002 | Cutler |
| 6,350,218 | B1 | 2/2002 | Dalebout et al. |
| 6,387,020 | B1 | 5/2002 | Simonson |
| 6,413,191 | B1 | 7/2002 | Harris |
| 6,422,980 | B1 | 7/2002 | Simonson |
| 6,447,424 | B1 | 9/2002 | Ashby et al. |
| 6,458,060 | B1 | 10/2002 | Watterson |
| 6,458,061 | B2 | 10/2002 | Simonson |
| 6,471,622 | B1 | 10/2002 | Hammer |
| 6,506,142 | B2 | 1/2003 | Itoh |
| 6,527,678 | B1 | 3/2003 | Wang |
| 6,547,698 | B2 | 4/2003 | Inagawa |
| 6,563,225 | B2 | 5/2003 | Soga |
| 6,601,016 | B1 | 7/2003 | Brown |
| 6,623,140 | B2 | 9/2003 | Watterson |
| 6,626,799 | B2 | 9/2003 | Watterson |
| 6,652,424 | B2 | 11/2003 | Dalebout |
| 6,685,607 | B1 | 2/2004 | Olson |
| 6,695,581 | B2 | 2/2004 | Wasson |
| 6,701,271 | B2 | 3/2004 | Willner |
| 6,702,719 | B1 | 3/2004 | Brown |
| 6,712,740 | B2 | 3/2004 | Simonson |
| 6,719,667 | B2 | 4/2004 | Wong |
| 6,730,002 | B2 | 5/2004 | Hald |
| 6,743,153 | B2 | 6/2004 | Watterson |
| 6,746,371 | B1 | 6/2004 | Brown |

(56) References Cited

U.S. PATENT DOCUMENTS

| | | | |
|---|---|---|---|
| 6,749,537 | B1 | 6/2004 | Hickman |
| 6,761,667 | B1 | 7/2004 | Cutler et al. |
| 6,770,015 | B2 | 8/2004 | Simonson |
| 6,783,482 | B2 | 8/2004 | Oglesby |
| 6,786,852 | B2 | 9/2004 | Watterson |
| 6,796,925 | B2 | 9/2004 | Martinez |
| 6,808,472 | B1 | 10/2004 | Hickman |
| 6,821,230 | B2 | 11/2004 | Dalebout |
| 6,830,540 | B2 | 12/2004 | Watterson |
| 6,863,641 | B1 | 3/2005 | Brown |
| 6,866,613 | B1 | 3/2005 | Brown |
| 6,875,160 | B2 | 4/2005 | Watterson |
| 6,878,101 | B2 | 4/2005 | Colley |
| D507,311 | S | 7/2005 | Butler |
| 6,918,858 | B2 | 7/2005 | Watterson |
| 6,921,351 | B1 | 7/2005 | Hickman |
| 6,974,404 | B1 | 12/2005 | Watterson |
| 6,997,852 | B2 | 2/2006 | Watterson |
| 7,025,713 | B2 | 4/2006 | Dalebout |
| D520,085 | S | 5/2006 | Willardson |
| 7,044,897 | B2 | 5/2006 | Myers |
| 7,052,442 | B2 | 5/2006 | Watterson |
| 7,060,006 | B1 | 6/2006 | Watterson |
| 7,060,008 | B2 | 6/2006 | Watterson et al. |
| 7,070,539 | B2 | 7/2006 | Brown |
| 7,070,542 | B2 | 7/2006 | Reyes |
| 7,097,588 | B2 | 8/2006 | Watterson |
| D527,776 | S | 9/2006 | Willardson |
| 7,112,168 | B2 | 9/2006 | Dalebout et al. |
| 7,125,369 | B2 | 10/2006 | Endelman |
| 7,128,693 | B2 | 10/2006 | Brown |
| 7,132,939 | B2 | 11/2006 | Tyndall |
| 7,153,240 | B1 | 12/2006 | Wu |
| 7,166,062 | B1 | 1/2007 | Watterson |
| 7,166,064 | B2 | 1/2007 | Watterson |
| 7,169,087 | B2 | 1/2007 | Ercanbrack |
| 7,169,093 | B2 | 1/2007 | Simonson |
| 7,172,536 | B2 | 2/2007 | Liu |
| 7,192,387 | B2 | 3/2007 | Mendel |
| 7,192,388 | B2 | 3/2007 | Dalebout |
| 7,250,022 | B2 | 7/2007 | Dalebout |
| 7,282,016 | B2 | 10/2007 | Simonson |
| 7,285,075 | B2 | 10/2007 | Cutler |
| 7,344,481 | B2 | 3/2008 | Watterson |
| 7,377,882 | B2 | 5/2008 | Watterson |
| 7,425,188 | B2 | 9/2008 | Ercanbrack |
| 7,429,236 | B2 | 9/2008 | Dalebout |
| 7,452,311 | B2 | 11/2008 | Barnes |
| 7,455,622 | B2 | 11/2008 | Watterson |
| 7,470,219 | B2 | 12/2008 | Larson |
| 7,482,050 | B2 | 1/2009 | Olson |
| D588,655 | S | 3/2009 | Utykanski |
| 7,510,509 | B2 | 3/2009 | Hickman |
| 7,537,546 | B2 | 5/2009 | Watterson |
| 7,537,549 | B2 | 5/2009 | Nelson |
| 7,537,552 | B2 | 5/2009 | Dalebout |
| 7,540,828 | B2 | 6/2009 | Watterson |
| 7,549,947 | B2 | 6/2009 | Hickman |
| 7,556,590 | B2 | 7/2009 | Watterson et al. |
| 7,563,203 | B2 | 7/2009 | Dalebout |
| 7,575,536 | B1 | 8/2009 | Hickman |
| 7,578,771 | B1 | 8/2009 | Towley, III |
| 7,601,105 | B1 | 10/2009 | Gipson, III |
| 7,604,573 | B2 | 10/2009 | Dalebout |
| D604,373 | S | 11/2009 | Dalebout |
| 7,618,350 | B2 | 11/2009 | Dalebout |
| 7,618,357 | B2 | 11/2009 | Dalebout |
| 7,625,315 | B2 | 12/2009 | Hickman |
| 7,625,321 | B2 | 12/2009 | Simonson |
| 7,628,730 | B1 | 12/2009 | Watterson |
| 7,628,737 | B2 | 12/2009 | Kowallis |
| 7,637,847 | B1 | 12/2009 | Hickman |
| 7,645,212 | B2 | 1/2010 | Ashby et al. |
| 7,645,213 | B2 | 1/2010 | Watterson |
| 7,658,698 | B2 | 2/2010 | Pacheco |
| 7,674,205 | B2 | 3/2010 | Dalebout |
| 7,713,171 | B1 | 5/2010 | Hickman |
| 7,713,172 | B2 | 5/2010 | Watterson |
| 7,713,180 | B2 | 5/2010 | Wickens |
| 7,717,828 | B2 | 5/2010 | Simonson |
| 7,736,279 | B2 | 6/2010 | Dalebout |
| 7,740,563 | B2 | 6/2010 | Dalebout |
| 7,749,144 | B2 | 7/2010 | Hammer |
| 7,766,797 | B2 | 8/2010 | Dalebout |
| 7,771,320 | B2 | 8/2010 | Riley |
| 7,771,329 | B2 | 8/2010 | Dalebout |
| 7,775,940 | B2 | 8/2010 | Dalebout |
| 7,789,800 | B1 | 9/2010 | Watterson |
| 7,798,946 | B2 | 9/2010 | Dalebout |
| 7,806,589 | B2 | 10/2010 | Tashman |
| 7,815,548 | B2 | 10/2010 | Barre |
| 7,815,550 | B2 | 10/2010 | Watterson |
| 7,857,731 | B2 | 12/2010 | Hickman |
| 7,862,475 | B2 | 1/2011 | Watterson |
| 7,862,478 | B2 | 1/2011 | Watterson |
| 7,862,483 | B2 | 1/2011 | Hendrickson |
| 7,862,489 | B2 | 1/2011 | Savsek |
| 7,887,470 | B2 | 2/2011 | Chen |
| D635,207 | S | 3/2011 | Dalebout |
| 7,901,324 | B2 | 3/2011 | Kodama |
| 7,901,330 | B2 | 3/2011 | Dalebout |
| 7,909,740 | B2 | 3/2011 | Dalebout |
| 7,980,996 | B2 | 7/2011 | Hickman |
| 7,981,000 | B2 | 7/2011 | Watterson |
| 7,985,164 | B2 | 7/2011 | Ashby |
| 8,007,409 | B2 | 8/2011 | Ellis |
| 8,029,415 | B2 | 10/2011 | Ashby et al. |
| 8,033,960 | B1 | 10/2011 | Dalebout |
| D650,451 | S | 12/2011 | Olson |
| 8,075,453 | B1 | 12/2011 | Wilkinson |
| D652,877 | S | 1/2012 | Dalebout |
| 8,152,702 | B2 | 4/2012 | Pacheco |
| 8,157,708 | B2 | 4/2012 | Daly |
| D659,775 | S | 5/2012 | Olson |
| D659,777 | S | 5/2012 | Watterson |
| D660,383 | S | 5/2012 | Watterson |
| D664,613 | S | 7/2012 | Dalebout |
| 8,251,874 | B2 | 8/2012 | Ashby |
| 8,257,232 | B2 | 9/2012 | Albert |
| 8,298,123 | B2 | 10/2012 | Hickman |
| 8,298,125 | B2 | 10/2012 | Colledge |
| D671,177 | S | 11/2012 | Sip |
| D671,178 | S | 11/2012 | Sip |
| 8,308,618 | B2 | 11/2012 | Bayerlein |
| D673,626 | S | 1/2013 | Olson |
| 8,608,624 | B2 | 12/2013 | Shabodyash |
| 8,690,735 | B2 | 4/2014 | Watterson |
| D707,763 | S | 6/2014 | Cutler |
| 8,740,753 | B2 | 6/2014 | Olson |
| 8,747,285 | B2 | 6/2014 | Hof |
| 8,758,201 | B2 | 6/2014 | Ashby |
| 8,771,153 | B2 | 7/2014 | Dalebout |
| 8,784,270 | B2 | 7/2014 | Watterson |
| 8,784,275 | B2 | 7/2014 | Mikan |
| 8,784,278 | B2 | 7/2014 | Flake |
| 8,808,148 | B2 | 8/2014 | Watterson |
| 8,814,762 | B2 | 8/2014 | Butler |
| D712,493 | S | 9/2014 | Ercanbrack |
| 8,840,075 | B2 | 9/2014 | Olson |
| 8,845,493 | B2 | 9/2014 | Watterson |
| 8,870,726 | B2 | 10/2014 | Watterson |
| 8,876,668 | B2 | 11/2014 | Hendrickson |
| 8,894,549 | B2 | 11/2014 | Colledge |
| 8,894,555 | B2 | 11/2014 | Olson |
| 8,911,330 | B2 | 12/2014 | Watterson |
| 8,920,288 | B2 | 12/2014 | Dalebout |
| 8,920,347 | B2 | 12/2014 | Bayerlein |
| 8,979,709 | B2 | 3/2015 | Toback |
| 8,986,165 | B2 | 3/2015 | Ashby |
| 8,992,364 | B2 | 3/2015 | Law |
| 8,992,387 | B2 | 3/2015 | Watterson |
| D726,476 | S | 4/2015 | Ercanbrack |
| 9,028,368 | B2 | 5/2015 | Ashby |
| 9,028,370 | B2 | 5/2015 | Watterson |

(56) References Cited

U.S. PATENT DOCUMENTS

| | | | |
|---|---|---|---|
| 9,039,578 | B2 | 5/2015 | Dalebout |
| D731,011 | S | 6/2015 | Buchanan |
| 9,044,636 | B2 | 6/2015 | Hao |
| 9,072,930 | B2 | 7/2015 | Ashby |
| 9,119,983 | B2 | 9/2015 | Rhea |
| 9,119,988 | B2 | 9/2015 | Murray |
| 9,123,317 | B2 | 9/2015 | Watterson |
| 9,126,071 | B2 | 9/2015 | Smith |
| 9,126,072 | B2 | 9/2015 | Watterson |
| 9,138,615 | B2 | 9/2015 | Olson |
| 9,142,139 | B2 | 9/2015 | Watterson |
| 9,144,703 | B2 | 9/2015 | Dalebout |
| 9,149,683 | B2 | 9/2015 | Smith |
| 9,186,535 | B2 | 11/2015 | Ercanbrack |
| 9,186,549 | B2 | 11/2015 | Watterson |
| 9,186,552 | B1 | 11/2015 | Deal |
| 9,227,101 | B2 | 1/2016 | Maguire |
| 9,233,272 | B2 | 1/2016 | Villani |
| 9,254,409 | B2 | 2/2016 | Dalebout |
| 9,254,416 | B2 | 2/2016 | Ashby |
| 9,278,248 | B2 | 3/2016 | Tyger |
| 9,278,249 | B2 | 3/2016 | Watterson |
| 9,278,250 | B2 | 3/2016 | Buchanan |
| 9,289,648 | B2 | 3/2016 | Watterson |
| 9,292,935 | B2 | 3/2016 | Koduri |
| 9,308,417 | B2 | 4/2016 | Grundy |
| 9,339,683 | B2 | 5/2016 | Dilli |
| 9,339,691 | B2 | 5/2016 | Brammer |
| 9,352,185 | B2 | 5/2016 | Hendrickson |
| 9,352,186 | B2 | 5/2016 | Watterson |
| 9,364,714 | B2 | 6/2016 | Koduri |
| 9,375,605 | B2 | 6/2016 | Tyger |
| 9,378,336 | B2 | 6/2016 | Ohnemus |
| 9,381,394 | B2 | 7/2016 | Mortensen |
| 9,387,387 | B2 | 7/2016 | Dalebout |
| 9,393,453 | B2 | 7/2016 | Watterson |
| 9,403,047 | B2 | 8/2016 | Olson |
| 9,403,051 | B2 | 8/2016 | Cutler |
| 9,421,416 | B2 | 8/2016 | Mortensen |
| 9,457,219 | B2 | 10/2016 | Smith |
| 9,457,220 | B2 | 10/2016 | Olson |
| 9,457,222 | B2 | 10/2016 | Dalebout |
| 9,460,632 | B2 | 10/2016 | Watterson |
| 9,463,356 | B2 | 10/2016 | Rhea |
| 9,468,794 | B2 | 10/2016 | Barton |
| 9,468,798 | B2 | 10/2016 | Dalebout |
| 9,480,874 | B2 | 11/2016 | Cutler |
| 9,492,704 | B2 | 11/2016 | Mortensen |
| 9,498,668 | B2 | 11/2016 | Smith |
| 9,517,378 | B2 | 12/2016 | Ashby |
| 9,521,901 | B2 | 12/2016 | Dalebout |
| 9,533,187 | B2 | 1/2017 | Dalebout |
| 9,539,461 | B2 | 1/2017 | Ercanbrack |
| 9,550,091 | B2 | 1/2017 | Emerson |
| 9,579,544 | B2 | 2/2017 | Watterson |
| 9,586,086 | B2 | 3/2017 | Dalebout |
| 9,586,090 | B2 | 3/2017 | Watterson |
| 9,604,099 | B2 | 3/2017 | Taylor |
| 9,616,276 | B2 | 4/2017 | Dalebout |
| 9,616,278 | B2 | 4/2017 | Olson |
| 9,623,281 | B2 | 4/2017 | Hendrickson |
| 9,636,567 | B2 | 5/2017 | Brammer |
| 9,675,839 | B2 | 6/2017 | Dalebout |
| 9,682,307 | B2 | 6/2017 | Dalebout |
| 9,694,234 | B2 | 7/2017 | Dalebout |
| 9,694,242 | B2 | 7/2017 | Ashby |
| 9,737,755 | B2 | 8/2017 | Dalebout |
| 9,750,454 | B2 | 9/2017 | Walke |
| 9,757,605 | B2 | 9/2017 | Olson |
| 9,764,186 | B2 | 9/2017 | Dalebout |
| 9,767,785 | B2 | 9/2017 | Ashby |
| 9,776,032 | B2 | 10/2017 | Moran |
| 9,795,822 | B2 | 10/2017 | Smith |
| 9,795,855 | B2 | 10/2017 | Jafarifesharaki |
| 9,808,672 | B2 | 11/2017 | Dalebout |
| 9,849,326 | B2 | 12/2017 | Smith |
| 9,878,210 | B2 | 1/2018 | Watterson |
| 9,889,334 | B2 | 2/2018 | Ashby |
| 9,889,339 | B2 | 2/2018 | Douglass |
| 9,937,376 | B2 | 4/2018 | McInelly |
| 9,937,377 | B2 | 4/2018 | McInelly |
| 9,937,378 | B2 | 4/2018 | Dalebout |
| 9,937,379 | B2 | 4/2018 | Mortensen |
| 9,943,719 | B2 | 4/2018 | Smith |
| 9,943,722 | B2 | 4/2018 | Dalebout |
| 9,948,037 | B2 | 4/2018 | Ashby |
| 9,968,816 | B2 | 5/2018 | Olson |
| 9,968,821 | B2 | 5/2018 | Finlayson |
| 9,968,823 | B2 | 5/2018 | Cutler |
| 9,980,465 | B2 | 5/2018 | Hayashi |
| 10,010,755 | B2 | 7/2018 | Watterson |
| 10,010,756 | B2 | 7/2018 | Watterson |
| 10,029,145 | B2 | 7/2018 | Douglass |
| D826,350 | S | 8/2018 | Hochstrasser |
| 10,046,196 | B2 | 8/2018 | Ercanbrack |
| D827,733 | S | 9/2018 | Hochstrasser |
| 10,065,064 | B2 | 9/2018 | Smith |
| 10,071,285 | B2 | 9/2018 | Smith |
| 10,085,586 | B2 | 10/2018 | Smith |
| 10,086,254 | B2 | 10/2018 | Watterson |
| 10,118,064 | B1 | 11/2018 | Cox |
| 10,136,842 | B2 | 11/2018 | Ashby |
| 10,186,161 | B2 | 1/2019 | Watterson |
| 10,188,890 | B2 | 1/2019 | Olson |
| 10,207,143 | B2 | 2/2019 | Dalebout |
| 10,207,145 | B2 | 2/2019 | Tyger |
| 10,207,147 | B2 | 2/2019 | Ercanbrack |
| 10,207,148 | B2 | 2/2019 | Powell |
| 10,212,994 | B2 | 2/2019 | Watterson |
| 10,220,259 | B2 | 3/2019 | Brammer |
| 10,226,396 | B2 | 3/2019 | Ashby |
| 10,226,664 | B2 | 3/2019 | Dalebout |
| 10,252,109 | B2 | 4/2019 | Watterson |
| 10,258,828 | B2 | 4/2019 | Dalebout |
| 10,272,317 | B2 | 4/2019 | Watterson |
| 10,279,212 | B2 | 5/2019 | Dalebout |
| 10,293,211 | B2 | 5/2019 | Watterson |
| D852,292 | S | 6/2019 | Cutler |
| 10,343,017 | B2 | 7/2019 | Jackson |
| 10,376,736 | B2 | 8/2019 | Powell |
| 10,388,183 | B2 | 8/2019 | Watterson |
| 10,391,361 | B2 | 8/2019 | Watterson |
| D864,320 | S | 10/2019 | Weston |
| D864,321 | S | 10/2019 | Weston |
| 10,426,989 | B2 | 10/2019 | Dalebout |
| 10,433,612 | B2 | 10/2019 | Ashby |
| 10,441,840 | B2 | 10/2019 | Dalebout |
| 10,449,416 | B2 | 10/2019 | Dalebout |
| D868,909 | S | 12/2019 | Cutler |
| 10,492,519 | B2 | 12/2019 | Capell |
| 10,493,349 | B2 | 12/2019 | Watterson |
| 10,500,473 | B2 | 12/2019 | Watterson |
| 10,543,395 | B2 | 1/2020 | Powell et al. |
| 10,561,877 | B2 | 2/2020 | Workman |
| 10,561,893 | B2 | 2/2020 | Chatterton |
| 10,561,894 | B2 | 2/2020 | Dalebout |
| 10,569,121 | B2 | 2/2020 | Watterson |
| 10,569,123 | B2 | 2/2020 | Hochstrasser |
| 2002/0016235 | A1 | 2/2002 | Ashby |
| 2002/0077221 | A1 | 6/2002 | Dalebout |
| 2002/0128127 | A1 | 9/2002 | Chen |
| 2002/0159253 | A1 | 10/2002 | Dalebout |
| 2003/0045406 | A1 | 3/2003 | Stone |
| 2003/0171189 | A1 | 9/2003 | Kaufman |
| 2004/0091307 | A1 | 5/2004 | James |
| 2004/0171464 | A1 | 9/2004 | Ashby |
| 2004/0171465 | A1 | 9/2004 | Hald |
| 2005/0049123 | A1 | 3/2005 | Dalebout |
| 2005/0077805 | A1 | 4/2005 | Dalebout |
| 2005/0107229 | A1 | 5/2005 | Wickens |
| 2005/0130814 | A1 | 6/2005 | Nitta |
| 2005/0164839 | A1 | 7/2005 | Watterson |
| 2005/0272577 | A1 | 12/2005 | Olson |
| 2005/0277520 | A1 | 12/2005 | Van Waes |

(56) References Cited

U.S. PATENT DOCUMENTS

2006/0135322 A1 6/2006 Rocker
2006/0217237 A1 9/2006 Rhodes
2006/0240955 A1 10/2006 Pu
2006/0240959 A1 10/2006 Huang
2007/0066448 A1 3/2007 Pan
2007/0117683 A1 5/2007 Ercanbrack
2007/0197353 A1 8/2007 Hundley
2007/0254778 A1 11/2007 Ashby
2008/0051256 A1 2/2008 Ashby
2008/0119337 A1 5/2008 Wilkins
2008/0242520 A1 10/2008 Hubbard
2008/0300110 A1 12/2008 Smith
2009/0036273 A1* 2/2009 Reyes ..... A63B 24/00 600/301
2009/0105052 A1 4/2009 Dalebout
2010/0197462 A1 8/2010 Piane, Jr.
2010/0242246 A1 9/2010 Dalebout
2010/0317488 A1 12/2010 Cartaya
2011/0131005 A1 6/2011 Ueshima
2012/0178590 A1* 7/2012 Lu ..... A63B 22/0235 482/54
2012/0237911 A1 9/2012 Watterson
2012/0295774 A1 11/2012 Dalebout
2013/0014321 A1 1/2013 Sullivan
2013/0065732 A1 3/2013 Hopp
2013/0123083 A1 5/2013 Sip
2013/0150214 A1 6/2013 Wu
2013/0165195 A1 6/2013 Watterson
2013/0172152 A1 7/2013 Watterson
2013/0172153 A1 7/2013 Watterson
2013/0178334 A1 7/2013 Brammer
2013/0178768 A1 7/2013 Dalebout
2013/0190136 A1 7/2013 Watterson
2013/0196298 A1 8/2013 Watterson
2013/0196821 A1 8/2013 Watterson
2013/0196822 A1 8/2013 Watterson
2013/0218585 A1 8/2013 Watterson
2013/0244836 A1 9/2013 Maughan
2013/0267383 A1 10/2013 Watterson
2013/0268101 A1 10/2013 Brammer
2013/0274067 A1 10/2013 Watterson
2013/0281241 A1 10/2013 Watterson
2014/0024499 A1 1/2014 Watterson
2014/0073970 A1 3/2014 Ashby
2014/0121071 A1 5/2014 Strom
2014/0135173 A1 5/2014 Watterson
2014/0187389 A1 7/2014 Berg
2014/0274574 A1 9/2014 Shorten
2014/0274579 A1 9/2014 Olson
2014/0287884 A1 9/2014 Buchanan
2014/0309085 A1 10/2014 Watterson
2015/0038300 A1 2/2015 Forhan
2015/0182779 A1 7/2015 Dalebout
2015/0182781 A1 7/2015 Watterson
2015/0238817 A1 8/2015 Watterson
2015/0250418 A1 9/2015 Ashby
2015/0251055 A1 9/2015 Ashby
2015/0253735 A1 9/2015 Watterson
2015/0253736 A1 9/2015 Watterson
2015/0258560 A1 9/2015 Ashby
2015/0367161 A1 12/2015 Wiegardt
2016/0058335 A1 3/2016 Ashby
2016/0063615 A1 3/2016 Watterson
2016/0092909 A1 3/2016 Watterson
2016/0101311 A1 4/2016 Workman
2016/0107065 A1 4/2016 Brammer
2016/0121074 A1 5/2016 Ashby
2016/0148535 A1 5/2016 Ashby
2016/0148536 A1 5/2016 Ashby
2016/0158595 A1 6/2016 Dalebout
2016/0206248 A1 7/2016 Sartor et al.
2016/0339298 A1 11/2016 Kats
2016/0346595 A1 12/2016 Dalebout
2016/0346617 A1 12/2016 Srugo
2017/0036053 A1 2/2017 Smith
2017/0056711 A1 3/2017 Dalebout
2017/0056715 A1 3/2017 Dalebout
2017/0124912 A1 5/2017 Ashby
2017/0193578 A1 7/2017 Watterson
2017/0266489 A1 9/2017 Douglass
2017/0266533 A1 9/2017 Dalebout
2017/0270820 A1 9/2017 Ashby
2017/0333747 A1* 11/2017 Athey ..... A63B 21/15
2018/0001135 A1 1/2018 Powell
2018/0036585 A1 2/2018 Powell
2018/0085630 A1 3/2018 Capell
2018/0089396 A1 3/2018 Capell
2018/0099116 A1 4/2018 Ashby
2018/0099180 A1 4/2018 Wilkinson
2018/0111034 A1 4/2018 Watterson
2018/0117385 A1 5/2018 Watterson
2018/0117393 A1 5/2018 Ercanbrack
2018/0154209 A1 6/2018 Watterson
2018/0200566 A1 7/2018 Weston
2019/0058370 A1 2/2019 Tinney
2019/0080624 A1 3/2019 Watterson
2019/0151698 A1 5/2019 Olson
2019/0168072 A1 6/2019 Brammer
2019/0178313 A1 6/2019 Wrobel
2019/0192898 A1 6/2019 Dalebout
2019/0192952 A1 6/2019 Powell
2019/0209893 A1 7/2019 Watterson
2019/0223612 A1 7/2019 Watterson
2019/0232112 A1 8/2019 Dalebout
2019/0269958 A1 9/2019 Dalebout
2019/0269971 A1 9/2019 Capell
2019/0275366 A1 9/2019 Powell
2019/0282852 A1 9/2019 Dalebout
2019/0328079 A1 10/2019 Ashby
2019/0329091 A1 10/2019 Powell
2019/0376585 A1 12/2019 Buchanan
2020/0009417 A1 1/2020 Dalebout
2020/0016459 A1 1/2020 Smith
2020/0238130 A1 7/2020 Silcock
2020/0254295 A1 8/2020 Watterson
2020/0254309 A1 8/2020 Watterson
2020/0254311 A1 8/2020 Watterson

FOREIGN PATENT DOCUMENTS

TW I339127 8/2008
TW M422981 2/2012
TW M504568 3/2015
WO 2000030717 6/2000
WO 2009014330 1/2009

OTHER PUBLICATIONS

U.S. Appl. No. 15/973,176, filed May 7, 2018, Melanie Douglass.
U.S. Appl. No. 16/879,376, filed May 22, 2019, David Hays.
U.S. Appl. No. 16/992,870, filed Aug. 15, 2019, Gaylen Ercanbrack.
U.S. Appl. No. 16/992,886, filed Aug. 15, 2019, William T. Dalebout.
U.S. Appl. No. 29/702,127, filed Sep. 16, 2019.
U.S. Appl. No. 62/897,113, filed Sep. 9, 2019, Megan Jane Ostler.
U.S. Appl. No. 62/914,007, filed Oct. 11, 2019, Jared Willardson.
U.S. Appl. No. 62/934,291, filed Nov. 12, 2019, William T. Dalebout.
U.S. Appl. No. 62/934,297, filed Nov. 12, 2019, William T. Dalebout.
English Translation of Search Report for Taiwan Patent Application No. 104131458 dated Jun. 3, 2016.
English Translation of Search Report for Taiwan Patent Application No. 105126694 dated Oct. 3, 2017.
International Search Report and Written Opinion issued in PCT/US2016/048692 dated Dec. 1, 2016.
International Search Report and Written Opinion issued in PCT/US2017/023002 dated Jun. 28, 2017.
International Search Report and Written Opinion issued in PCT/US2017/022989 dated May 23, 2017.

* cited by examiner

TREADMILL WITH A SCALE MECHANISM IN A MOTOR COVER

RELATED APPLICATIONS

This application is a continuation of U.S. patent application Ser. No. 15/461,271, filed Mar. 16, 2017, which claims priority to U.S. Patent Application Ser. No. 62/310,279 titled "Treadmill with Removable Supports" and filed on 18 Mar. 2016, which applications are herein incorporated by reference for all that they discloses.

BACKGROUND

Aerobic exercise is a popular form of exercise that improves one's cardiovascular health by reducing blood pressure and providing other benefits to the human body. Aerobic exercise generally involves low intensity physical exertion over a long duration of time. Typically, the human body can adequately supply enough oxygen to meet the body's demands at the intensity levels involved with aerobic exercise. Popular forms of aerobic exercise include running, jogging, swimming, and cycling among others activities. In contrast, anaerobic exercise typically involves high intensity exercises over a short duration of time. Popular forms of anaerobic exercise include strength training and short distance running.

Many choose to perform aerobic exercises indoors, such as in a gym or their home. Often, a user uses an aerobic exercise machine to have an aerobic workout indoors. One type of aerobic exercise machine is a treadmill, which is a machine that has a running deck attached to a support frame. The running deck can support the weight of a person using the machine. The running deck incorporates a tread belt that is driven by a motor. A user can run or walk in place on the tread belt by running or walking at the tread belt's speed. The speed and other operations of the treadmill are generally controlled through a control module that is also attached to the support frame and within a convenient reach of the user. The control module can include a display, buttons for increasing or decreasing a speed of the conveyor belt, controls for adjusting a tilt angle of the running deck, or other controls. Other popular exercise machines that allow a user to perform aerobic exercises indoors include elliptical machines, rowing machines, stepper machines, and stationary bikes to name a few.

One type of treadmill is disclosed in U.S. Pat. No. 4,729,558 issued to Hai P. Kuo. In this reference, an improved running exerciser comprises a base frame having a first shaft and second shaft, a pair of inverted U-shaped members each mounted at one side of the base frame, a track in the form of endless loop around the first shaft and the second shaft, a pulley fastened on one end of the first shaft, a motor assembly having a tubular rod enclosing the first shaft, a pair of conical clutch discs put over a driving shaft of the motor assembly, a belt connecting the pulley to the clutch discs, a speed control mechanism mounted on one of the inverted U-shaped members for regulating speed of the track, and a stand for lifting a front end of the base frame to incline the endless loop to form a slope.

SUMMARY

In one embodiment, a treadmill includes a platform where the platform includes a first side panel and a second side panel spaced apart at a distance from the first side panel, and a gap defined between the first side panel and the second side panel. The treadmill also includes a running deck contained within the platform and exposed within the gap, a first pulley connected to the running deck, a second pulley connected to the running deck opposite the first pulley, a tread belt surrounding the first pulley and the second pulley, a first post removably connected to the platform, a second post removably connected to the platform, and a first rail transversely connected to the first post and the second post.

The running deck may include a deck length between the first pulley and the second pulley and a deck width transversely oriented with respect to the deck length where the deck width is at least 2.5 feet wide.

The platform may include a profile height of less than six inches.

The platform may include a profile height of less than four inches.

The platform may further define a recess and at least one of the first post and the second post may be connected to the platform within the recess.

The recess may include an electrical contact that forms an electrical connection with the at least one of the first post and the second post when an end of the first post of the second post is inserted into the recess.

The recess may include a pop-up cover that is urged upward when at least one of the first post and the second post is removed from the recess.

The treadmill may further include a flywheel connected to at least one of the first pulley and the second pulley. The flywheel may include a rotational axis, a flywheel length aligned with the rotational axis, and an outer diameter transverse the flywheel length. The flywheel length may be greater than the outer diameter.

The flywheel length may be at least 4.0 inches.

The flywheel length may be at least 6.0 inches.

The flywheel may be supported on a first flywheel end and a second flywheel end.

The treadmill may further include a display screen incorporated into the platform.

The treadmill may further include a third post removably connected to the platform, a fourth post removably connected to the platform, and a second rail transversely connected to the third post and the fourth post.

The second rail may be aligned with first rail and along a deck length of the deck.

In one embodiment, a platform where the platform includes a first side panel and a second side panel spaced apart at a distance from the first side panel, and a gap defined between the first side panel and the second side panel. The treadmill also includes a running deck contained within the platform and exposed within the gap, a first pulley connected to the running deck, a second pulley connected to the running deck opposite the first pulley, a tread belt surrounding the first pulley and the second pulley, a first post removably connected to the platform, a second post removably connected to the platform, a first rail transversely connected to the first post and the second post, the platform further defines a recess, at least one of the first post and the second post is connected to the platform within the recess, and the recess includes an electrical contact disposed within the recess forms an electrical connection with the at least one of the first post and the second post when an end of the first post of the second post is inserted into the recess.

The recess may include a pop-up cover that is urged upward when at least one of the first post and the second post is removed from the recess.

The treadmill may further include a flywheel connected to at least one of the first pulley and the second pulley. The flywheel may include a rotational axis, a flywheel length aligned with the rotational axis, and an outer diameter transverse the flywheel length. The flywheel length may be greater than the outer diameter.

The running deck may include a deck length between the first pulley and the second pulley and a deck width transversely oriented with respect to the deck length where the deck width is at least 2.5 feet wide.

The treadmill may further include a display screen incorporated into the platform.

In one embodiment, a treadmill includes a platform where the platform includes a first side panel and a second side panel spaced apart at a distance from the first side panel, and a gap defined between the first side panel and the second side panel. The treadmill also includes a running deck contained within the platform and exposed within the gap, a first pulley connected to the running deck, a second pulley connected to the running deck opposite the first pulley, a tread belt surrounding the first pulley and the second pulley, a first post removably connected to the platform, a second post removably connected to the platform, a first rail transversely connected to the first post and the second post, the platform further defines a recess, at least one of the first post and the second post is connected to the platform within the recess, and the recess includes an electrical contact disposed within the recess forms an electrical connection with the at least one of the first post and the second post when an end of the first post of the second post is inserted into the recess, the recess includes a pop-up cover that is urged upward when at least one of the first post and the second post is removed from the recess, and a flywheel connected to at least one of the first pulley and the second pulley. The flywheel includes a rotational axis, a flywheel length aligned with the rotational axis, and an outer diameter transverse the flywheel length. The flywheel is supported on a first flywheel end and a second flywheel end. The flywheel length is greater than the outer diameter. The running deck includes a deck length between the first pulley and the second pulley and a deck width transversely oriented with respect to the deck length where the deck width is at least 2.5 feet wide. Further, a display screen is incorporated into the platform.

In one embodiment, a treadmill includes a deck, a first pulley disposed in a first portion of the deck, a second pulley disposed in a second portion of the deck, a tread belt surrounding the first pulley and the second pulley, a scale mechanism incorporated into the deck, and a repetition counter is also incorporated into the treadmill.

The treadmill may include a motor in mechanical communication with at least one of the first pulley and the second pulley, a cover superjacent the motor, and the scale mechanism is incorporated into the cover over the motor.

The repetition counter may include a piezoelectric material.

The piezoelectric material may be incorporated into the cover.

The treadmill may include a free weight rack connected to the deck.

The treadmill may include a processor and memory and a display in communication with the processor where the processor is in communication with the scale mechanism and the repetition counter. The memory may include programmed instructions that, when executed, cause the processor to display a weight of a user.

The programmed instructions, when executed, may cause the processor to determine whether the user is holding a weight.

Determining whether the user is holding the weight may include measuring an increase with the scale mechanism.

The programmed instructions, when executed, may cause the processor to determine whether the user is executing an anaerobic exercise with a weight.

The programmed instructions, when executed, may cause the processor to count anaerobic exercise repetitions performed by the user with the repetition counter.

The programmed instructions, when executed, may cause the display to present a count of the anaerobic exercise repetitions.

The programmed instructions, when executed, may cause the processor to instruct the user to select a weight.

The programmed instructions, when executed, may cause the processor to instruct the user to perform an exercise with the weight.

The programmed instructions, when executed, may cause the processor to instruct the user to perform a pre-determined repetition count with the weight.

The programmed instructions, when executed, may cause the processor to verify that user selected weight by measuring the increase with the scale mechanism.

The programmed instructions, when executed, may cause the processor to verify that user performed the pre-determined repetitions with the repetition counter.

In one embodiment, a treadmill includes a deck, a first pulley disposed in a first portion of the deck, a second pulley disposed in a second portion of the deck, a tread belt surrounding the first pulley and the second pulley, a motor in mechanical communication with at least one of the first pulley and the second pulley, a cover superjacent the motor, a scale mechanism incorporated into the cover over the motor, a repetition counter having a piezoelectric material that is incorporated into the cover, and a free weight rack connected to the deck.

The treadmill may further include a processor and memory, a display in communication with the processor where the processor is also in communication with the scale mechanism and the repetition counter and where the memory includes programmed instructions that, when executed, cause the processor to display a weight of a user.

The programmed instructions, when executed, may cause the processor to instruct the user to select a weight and verify that user selected weight by measuring the increase with the scale mechanism.

In one embodiment, a treadmill includes a deck, a first pulley disposed in a first portion of the deck, a second pulley disposed in a second portion of the deck, a tread belt surrounding the first pulley and the second pulley, a motor in mechanical communication with at least one of the first pulley and the second pulley, a cover superjacent the motor, a scale mechanism incorporated into the cover over the motor, a repetition counter having a piezoelectric material that is incorporated into the cover, a free weight rack connected to the deck, a processor and memory, and a display in communication with the processor. The processor is in communication with the scale mechanism and the repetition counter and the memory includes programmed instructions that, when executed, cause the processor to instruct the user to select a weight, instruct the user to perform an exercise with the weight, instruct the user to perform a pre-determined repetition count with the weight, verify that user selected weight by measuring the increase with the scale mechanism, and verify that user performed the pre-determined repetitions with the repetition counter.

BRIEF DESCRIPTION OF THE DRAWINGS

The accompanying drawings illustrate various embodiments of the present apparatus and are a part of the specification. The illustrated embodiments are merely examples of the present apparatus and do not limit the scope thereof.

Throughout the drawings, identical reference numbers designate similar, but not necessarily identical, elements.

DETAILED DESCRIPTION

For purposes of this disclosure, the term "aligned" means parallel, substantially parallel, or forming an angle of less than 35.0 degrees. For purposes of this disclosure, the term "transverse" means perpendicular, substantially perpendicular, or forming an angle between 55.0 and 125.0 degrees. Also, for purposes of this disclosure, the term "length" means the longest dimension of an object. Also, for purposes of this disclosure, the term "width" means the dimension of an object from side to side. For the purposes of this disclosure, the term "above" generally means superjacent, substantially superjacent, or higher than another object although not directly overlying the object. Further, for purposes of this disclosure, the term "mechanical communication" generally refers to components being in direct physical contact with each other or being in indirect physical contact with each other where movement of one component affect the position of the other.

Figure 1:
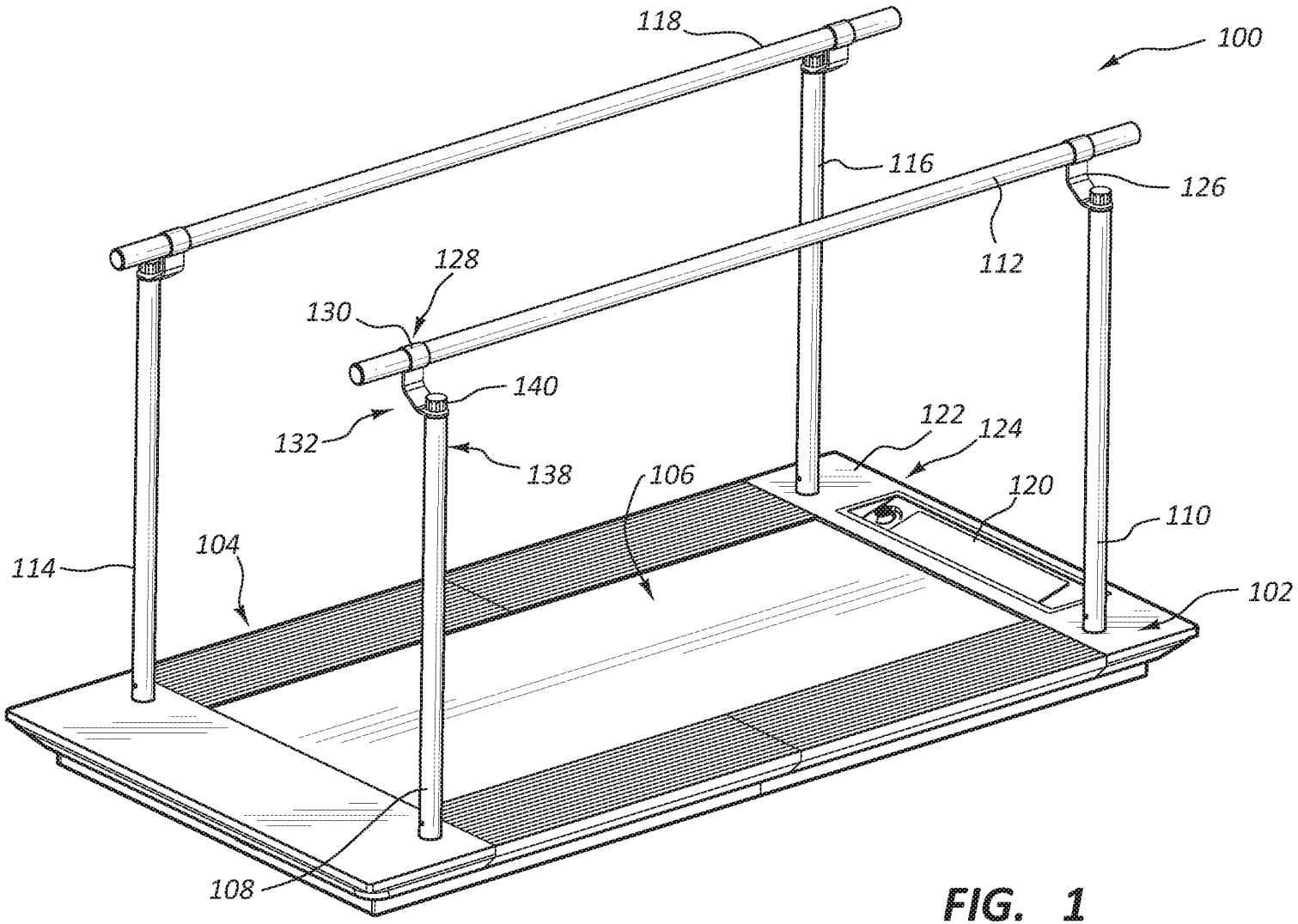
FIG. 1 illustrates a perspective view of an example of a treadmill in accordance with the present disclosure.

Particularly, with reference to the figures, FIG. 1 illustrates a perspective view of an example of a treadmill 100. In this example, the treadmill 100 includes a platform 102 with a first panel and a second panel that are spaced apart at a distance from one another. The space between the first panel and the second panel defines a gap 104. A running deck 106 is contained within the platform 102 and exposed within the gap 104. A first pulley (not shown) is connected to the running deck, and a second pulley (not shown) is connected to the running deck 106 opposite the first pulley. In the example of FIG. 1, the first and second pulleys are obscured from view underneath portions of a top surface of the platform 102. A tread belt surrounds the first pulley and the second pulley, and is accessible through the gap 104.

The platform 102 may have a length along its longest dimension and a width that is transverse the length. The platform's edges along both the width and the length have a wide section on which the user can stand.

The platform also includes a first post 108 that is removably connected to the platform 102, and a second post 110 that is removably connected to the platform 102. A first rail 112 transversely connects the first post 108 to the second post 110. In this example, the platform 102 also includes a third post 114 that is removably connected to the platform 102, and a fourth post 116 is also removably connected to the platform 102. Additionally, a second rail 118 connects the third post 114 to the fourth post 116. While this example has been described with four posts 108, 110, 114, 116 and two rails 112, 118, the treadmill may include any appropriate number of posts and rails. In the illustrated example, each of the posts 108, 110, 114, 116 is located in a corner of the platform 102.

The posts 108, 110, 114, 116 and rails 112, 118 can be used to support the user when performing exercises like conventional treadmill exercises (e.g. walking, running, cycling, etc), performing dancing activities, or performing other types of activities. In those situations where the user is executing dance routines and/or moves, the wide portion of the platform 102 subjacent the rails 112, 118 may be wide enough for both the user's feet without the user having a portion of his or her foot hanging of off the wide portion. Although, in some situations, the user can perform the dances routines and/or moves on the tread belt or any other appropriate location on the treadmill.

The platform 102 also includes a display screen 120 integrated into the platform's top surface 122. This display screen 120 may be used to display information associated with the workout, with the user, with local news, with other types of information, or combinations thereof. In this example, the platform 102 also incorporates at least one input mechanism 124. The input mechanism may be used to change an operational parameter of the treadmill, change the display screen's view, send a message, perform another task, or combinations thereof.

The platform 102 may be wider than conventional treadmill decks. For example, the platform 102 may be at least 2.5 feet wide. Further, the platform 102 may also have a lower profile than conventional treadmill decks. For example, the platform may have a profile of less than six inches. In this example, when the treadmill is placed on a hard support surface, the platform's top surface is spatially located less than six inches away from the top surface of the platform.

The first post 108 may be connected to the first rail 112 with an offset connector 126. A first end 128 of the offset connector 126 may include an eye 130 defined by the first end 128. The eye 130 may be sized to receive a cross section of the first rail 112. In this example, the first rail 112 may be slid into the eye 130. In some examples, the friction between an inside surface of the eye 130 and the outside surface of the first rail 112 may be sufficient to minimize movement between the first rail 112 and the offset connector 126. In other examples, the first rail 112 may snap into place as the first rail 112 is slid through the eye 130 when the first rail 112 reaches a desired location. Any appropriate mechanism for securing the first rail 112 in the eye 130 may be used in accordance with the present disclosure.

A second end 132 of the offset connector 126 defines an eye 130 that is sized to be positioned over a receptacle defined in a top end 138 of the first post 108. In the illustrated example, a screw 140 is fitted through the eye 130 of the offset connector 126 and into the top end 138 of the first post 108. The screw 140 may be drawn tightly into the top end's receptacle by twisting the screw 140 in a circular motion. The friction between the screw's outside surface and the receptacle's inside surface may be sufficient to hold the weight of the offset connector 126 and the first rail 112. One advantage of the offset connector 126 is to provide space superjacent the screw 140 so that the screw 140 is accessible to the user and the screw 140 can be hand tightened.

Figure 2:
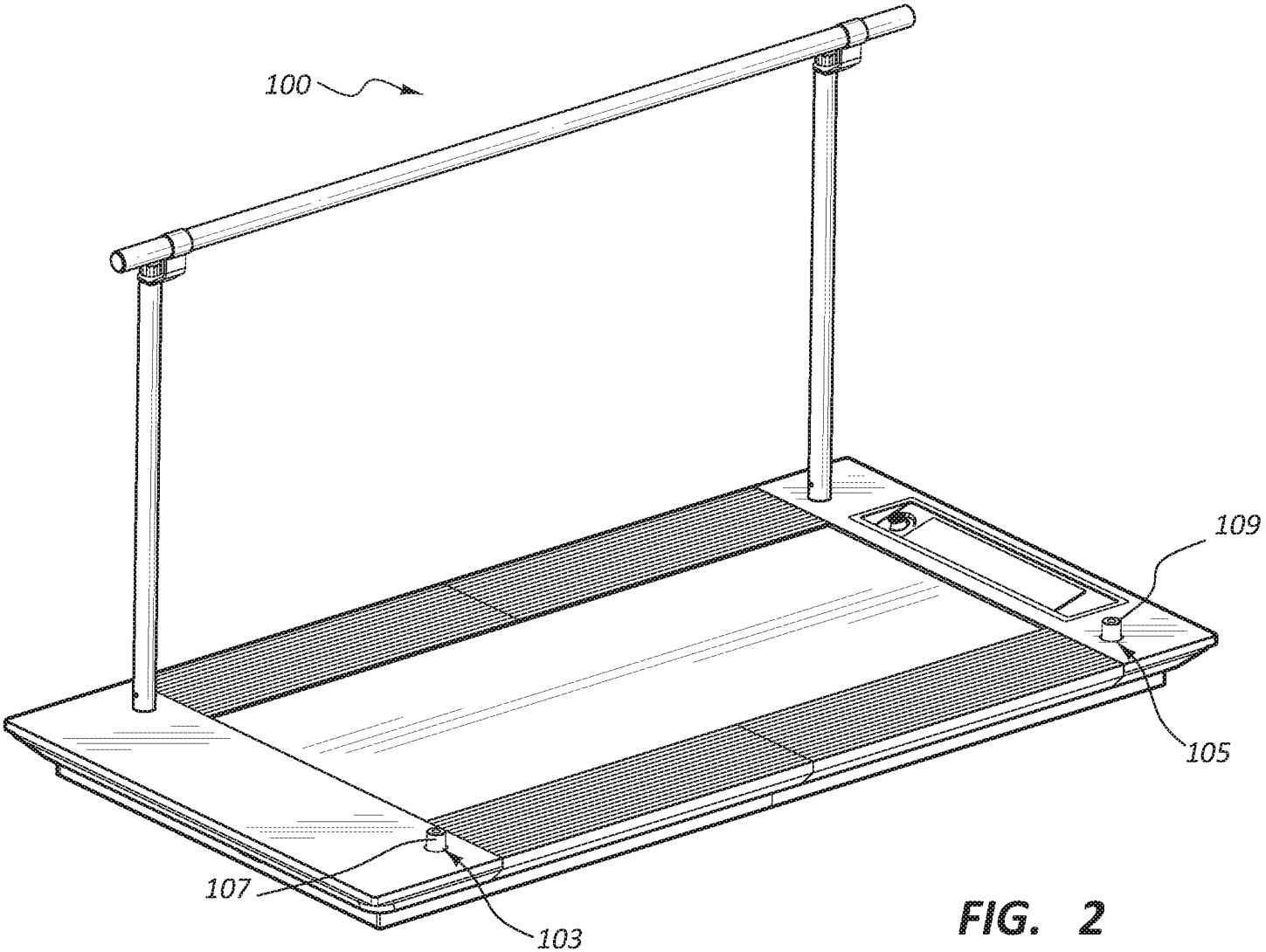
FIG. 2 illustrates a perspective diagram of an example of a treadmill in accordance with the present disclosure.

In the example of FIG. 2, the platform 100 is depicted with the first and second posts removed. In this example, the removal of the first and second posts exposes a first recess 103 in which the first post resided and a second recess 105 in which the second post resided. A first pop-up cover 107 is urged upward when the first post is removed and occupies a space defined by the first recess. Likewise, a second pop-up cover 109 is urged upward when the second post is removed and occupies a space defined by the second recess.

In some instances, the pop-up cover hides an electrical contact that is positioned in a side of either of the first recess or the second recess when the pop-up cover is urged upwards. In some instances, as an end of the first and/or second post is inserted back into the respective recess, the pop-up cover is displaced by the load applied from the insertion of the post. An electrically conductive portion of the end of the post may make direct or indirect contact with the electrical contact in the recess to establish an electrical connection. In these instances, electrical loads associated with the posts and/or rails may receive electrical power when the posts are inserted. For example, a control input may be incorporated into the rails and/or posts that generate an electrical load to operate.

Figure 3:
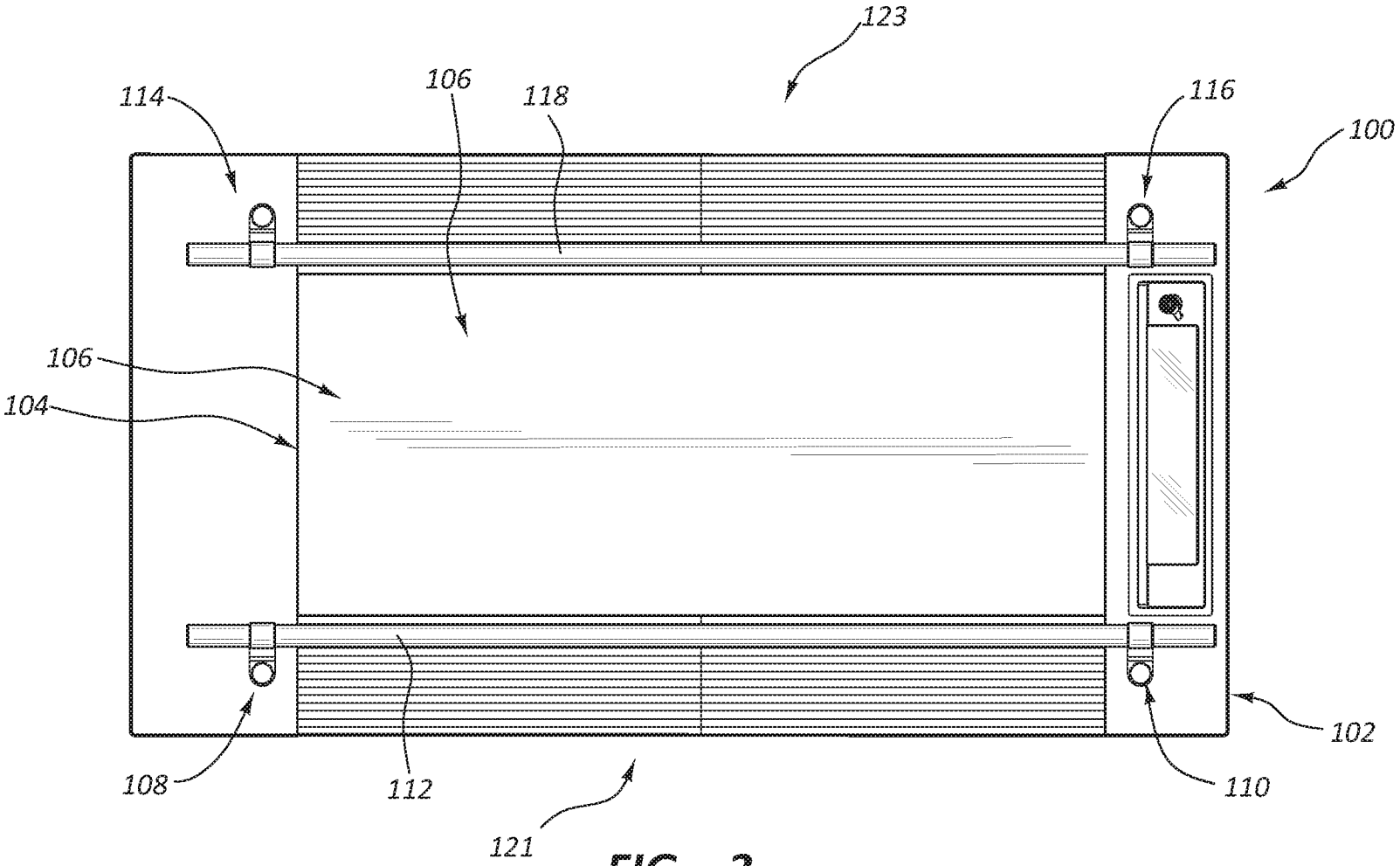
FIG. 3 illustrates a top view of an example of a treadmill in accordance with the present disclosure.

FIG. 3 illustrates a top view of an example of a treadmill 100. In this example, the treadmill 100 includes a platform 102. A first rail 112 and a second rail 118 are connected to the platform 102 with multiple posts 108, 110, 114, 116. In this example, the orientation of the first and second rails 112, 118 is aligned with a length of the treadmill 100.

A running deck 106 is exposed in a gap 104 defined in the platform 102. In this example, the first and second rails 112, 118, define a tread belt region. The platform 102 further includes a first side section 121 and a second side section 123. Each of the first and second side sections 121, 123 include a foot gripping that is on a side of the rails 112, 118 that is outside of the tread belt region.

Figure 4:
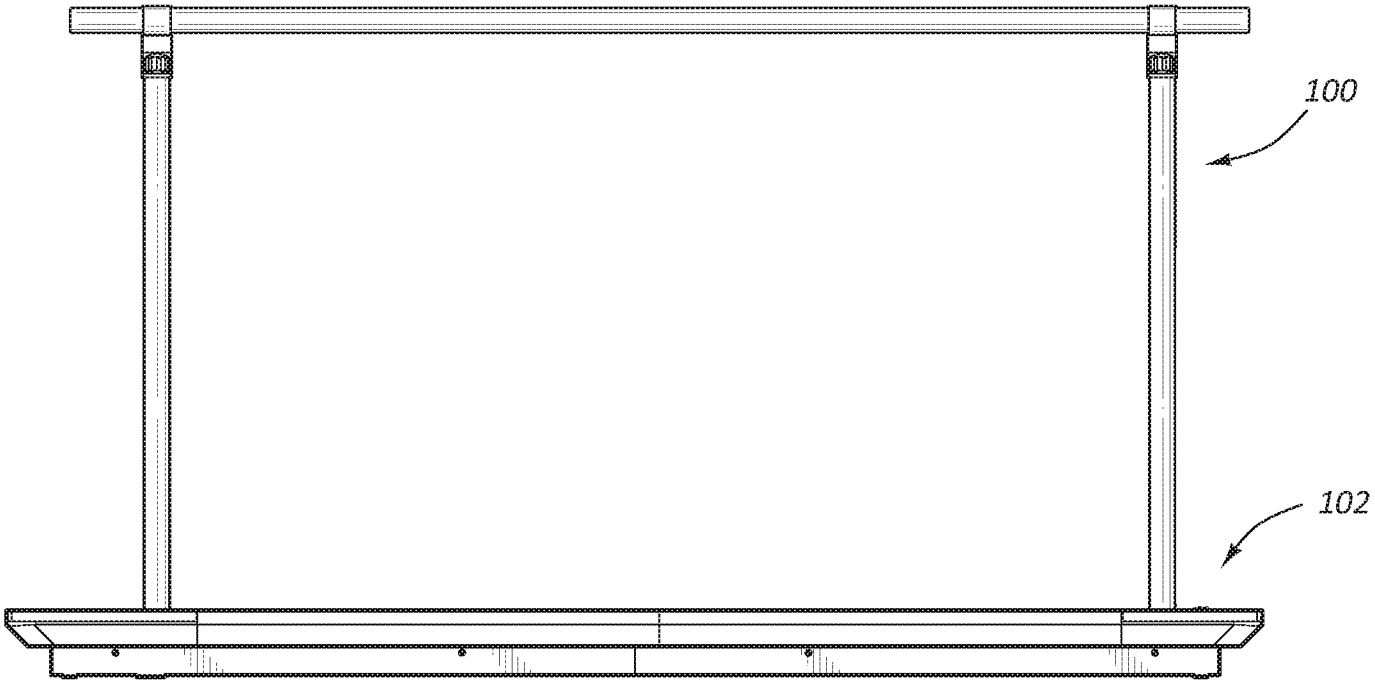
FIG. 4 illustrates a side view of an example of a treadmill in accordance with the present disclosure.

FIG. 4 illustrates a side view of a treadmill 100. In this example, the cross sectional height of the platform 102 is depicted. Components of the treadmill 100 are located within the cross sectional height of the treadmill, such as the motor, the pulleys, the tread belt, and so forth.

Figure 5:
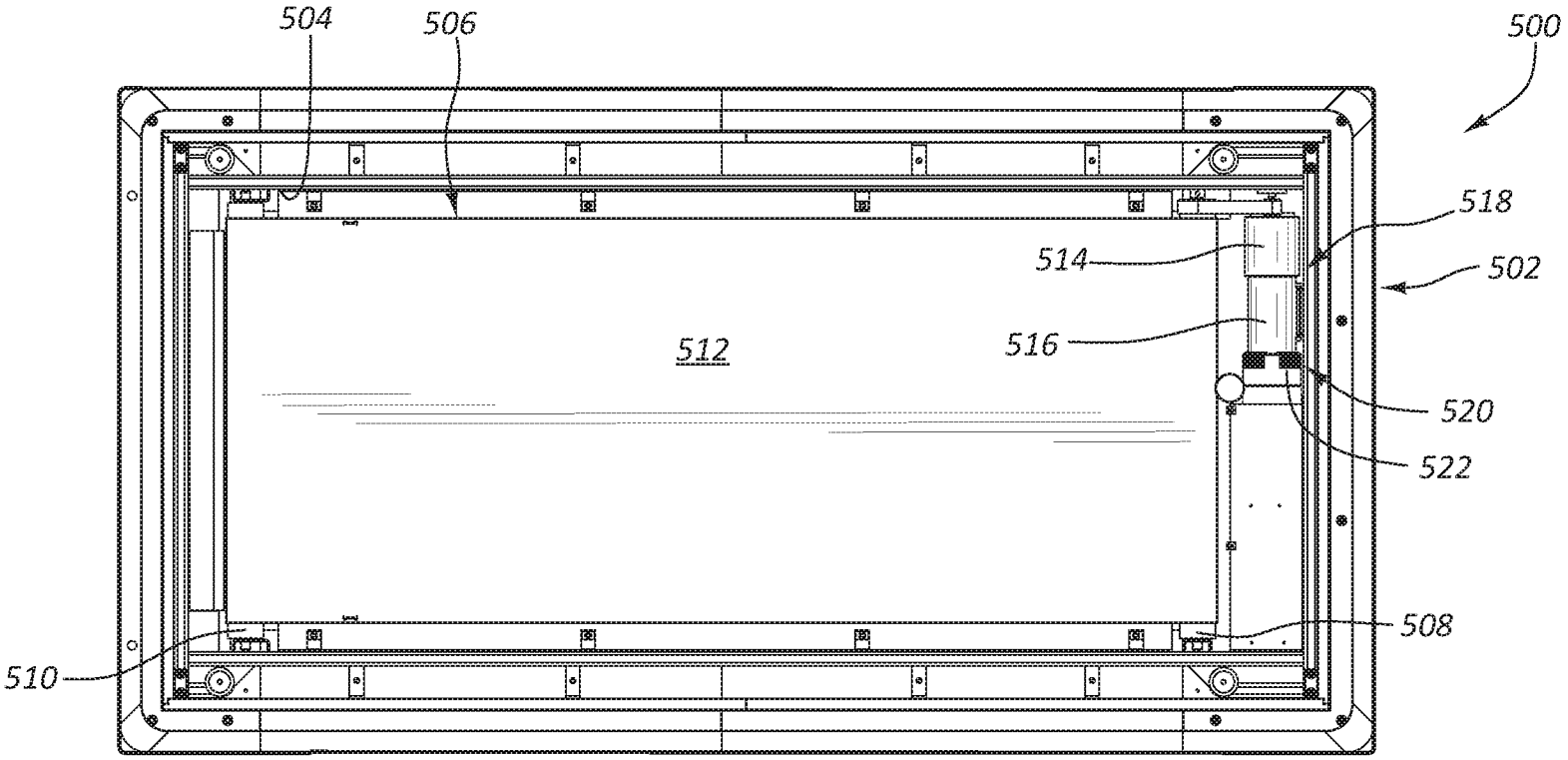
FIG. 5 illustrates a bottom view of an example of a treadmill in accordance with the present disclosure.
Figure 6:
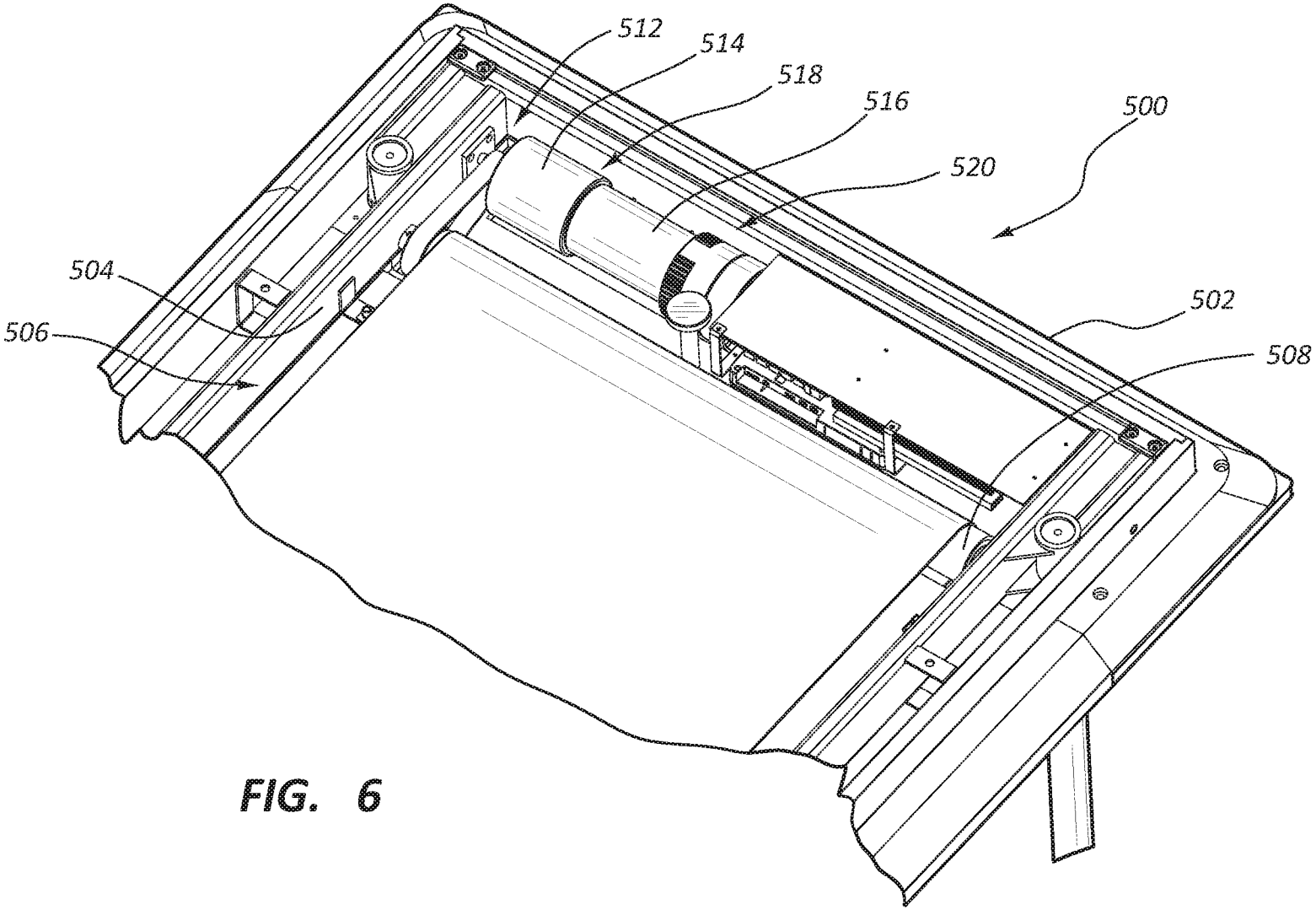
FIG. 6 illustrates a perspective view of an example of a flywheel in accordance with the present disclosure.

FIGS. 5 and 6 depict an example of an underside of a treadmill 500 with the treadmill's components exposed. In this example, the treadmill 500 includes a platform 502 that includes an inner surface 504. The inner surface 504 defines a gap 506 in the platform 502. A first pulley 508 and a second pulley 510 are connected to the inner surface 504 and a tread belt 512 surrounds the first and second pulleys 508, 510 within the gap 506. The first pulley 508 is rotated by a motor 514 that is connected to a flywheel 516. In this example, the motor 514 is connected to the first pulley 508 through a transmission belt that rotates the first pulley 508 as the motor's shaft rotates. The motor 514 is also connected to a first side 518 of the flywheel 516, and a second side 520 of the flywheel 516 is connected to a support 522 which is fixed to the platform 502. Thus, the flywheel is supported on its first side 518 and second side 520.

Figure 7:
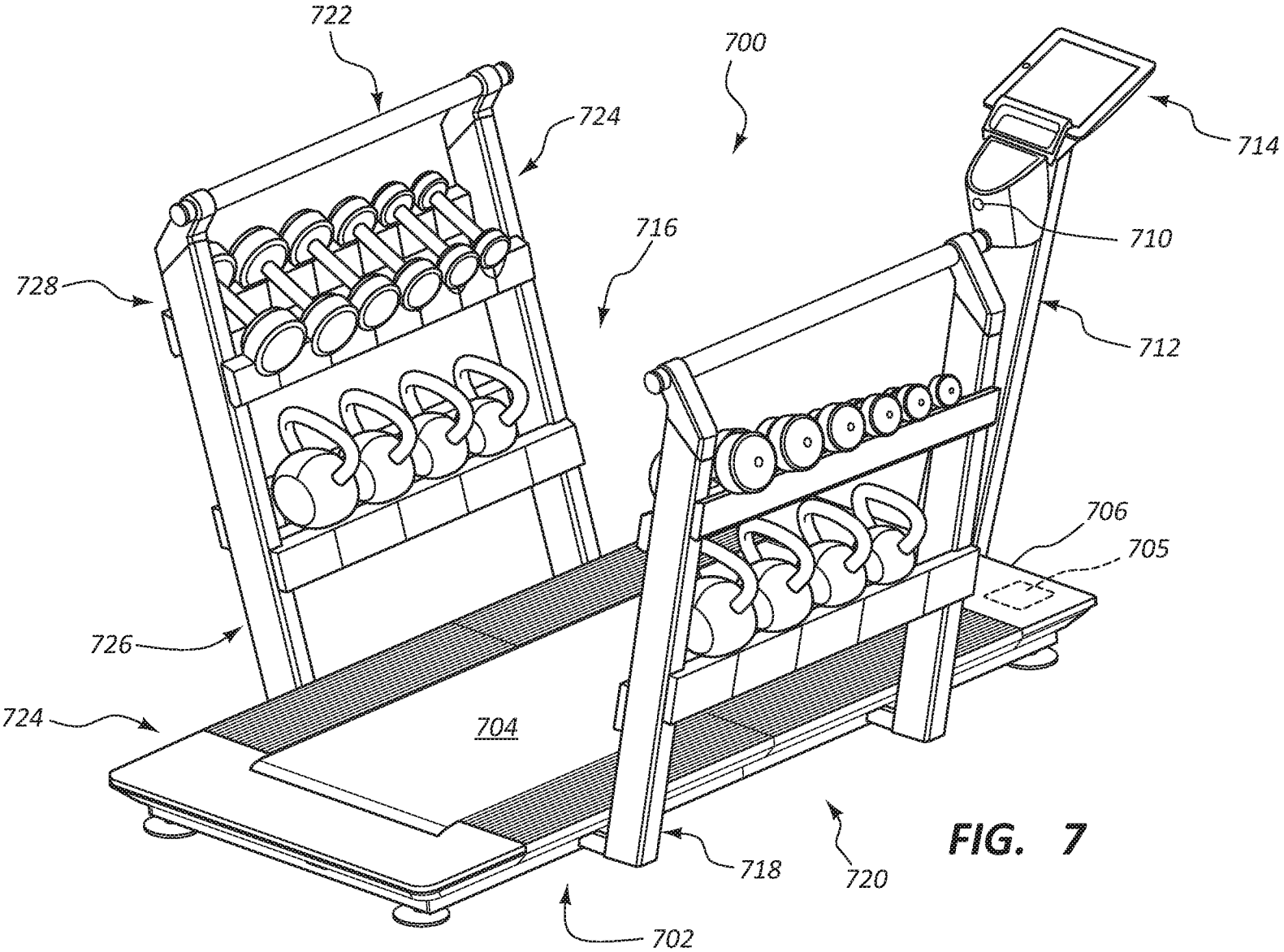
FIG. 7 illustrates a perspective view of an example of a treadmill in accordance with the present disclosure.

FIG. 7 depicts an example of a treadmill 700 having a deck 702 with a first pulley disposed in a first portion of the deck 702 and a second pulley incorporated into a second portion of the deck 702. A tread belt 704 surrounds the first pulley and the second pulley. A motor 705 is in mechanical communication with either the first pulley or the second pulley. A cover 706 is superjacent the motor 705. A scale mechanism is incorporated into the deck 702, and a repetition counter 710 is also incorporated into the treadmill.

The treadmill 700 also includes an upright portion 712 that supports a console 714. In this example, the repetition counter 710 is incorporated into the upright portion 712. In this example, the scale mechanism is obscured from view, but is incorporated into the cover 706 near the base of the upright portion 712.

Also incorporated into the treadmill 700 is a free weight rack 716. In this example, a first portion 718 of the free weight rack 716 is connected to a first side 720 of the deck 702, and a second portion 722 of the free weight rack 716 is connected to a second side 724 of the deck 702. The free weight rack 716 may include multiple tiers. In this example, each of the portions of the free weight rack 716 include a first tier 726 and a second tier 728. In some cases, each of the tiers include a cross member that includes features that prevent the free weights from slipping off of the rack. For example, the feature may include a lip, a recess, another type of feature, or combinations thereof.

Figure 8:
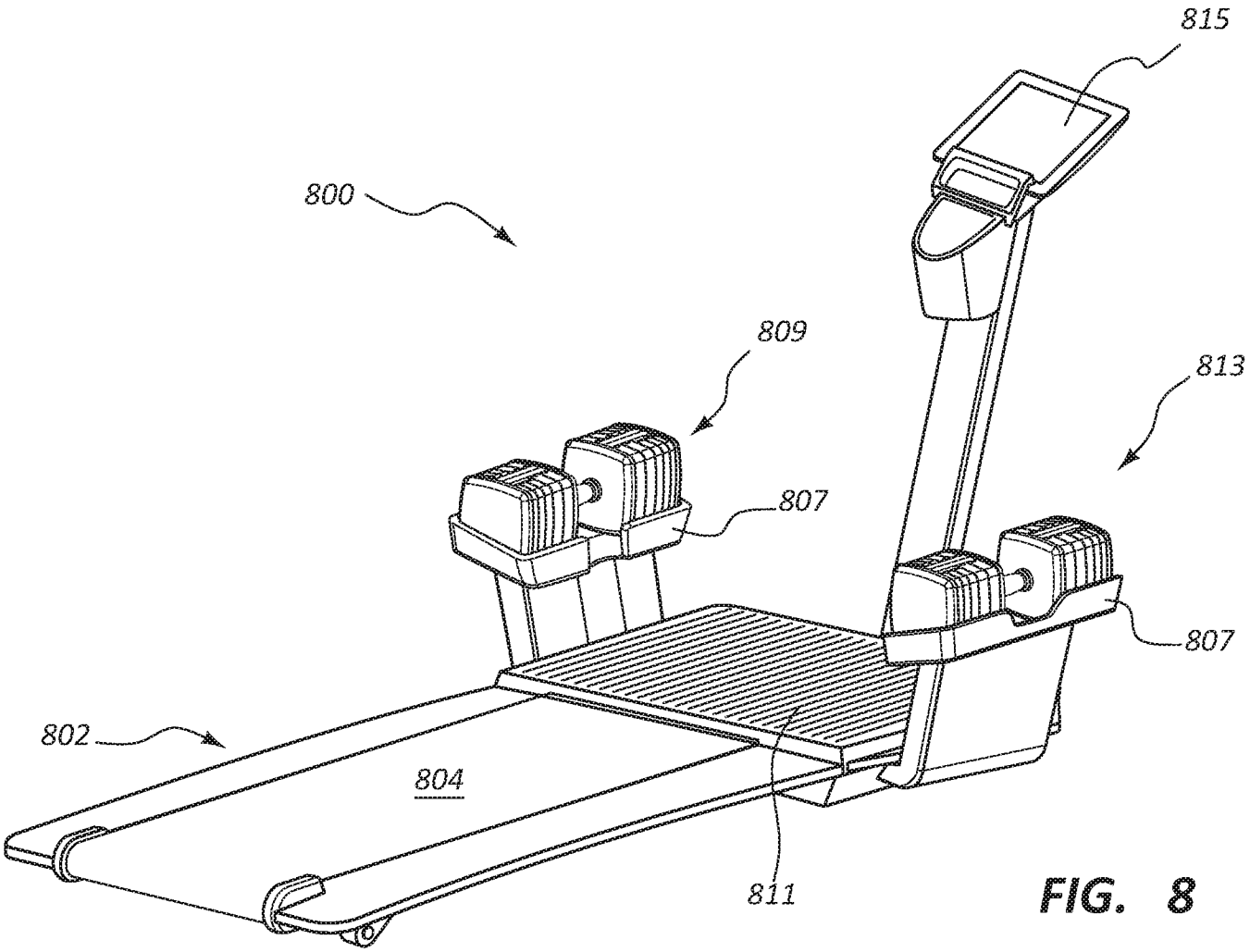
FIG. 8 illustrates a perspective view of an example of a treadmill in accordance with the present disclosure.

FIG. 8 depicts an example of a treadmill 800. In this example, the treadmill 800 includes a deck 802, and a tread belt 804 that surrounds a first pulley and second pulley incorporated into the deck 802. A free weight rack 807 is also incorporated into the treadmill 800. In this example, the free weight rack 807 includes just a single tier and supports an adjustable dumbbell 809.

A weight scale 811 is incorporated into the deck 802 at a front end 813 of the treadmill 800. In this example, the weight scale 811 is positioned over the motor that drives the first pulley and therefore drives the tread belt 804. As a user stands on the weight scale 811, the weight of the user can be presented in the console 815, in a display incorporated into the weight scale 811, in a mobile device, or in another computing device in communication with the weight scale, or combinations thereof. Additionally, when the user lifts the free weights off of the rack 807, the weight scale measures the combined weight of the user and the free weights. In some cases, the fluctuation of the weight scale's measurements that occur as the user performs an anaerobic exercise with the free weights is used by the repetition counter to determine how many lifts the user has performed.

Figure 9:
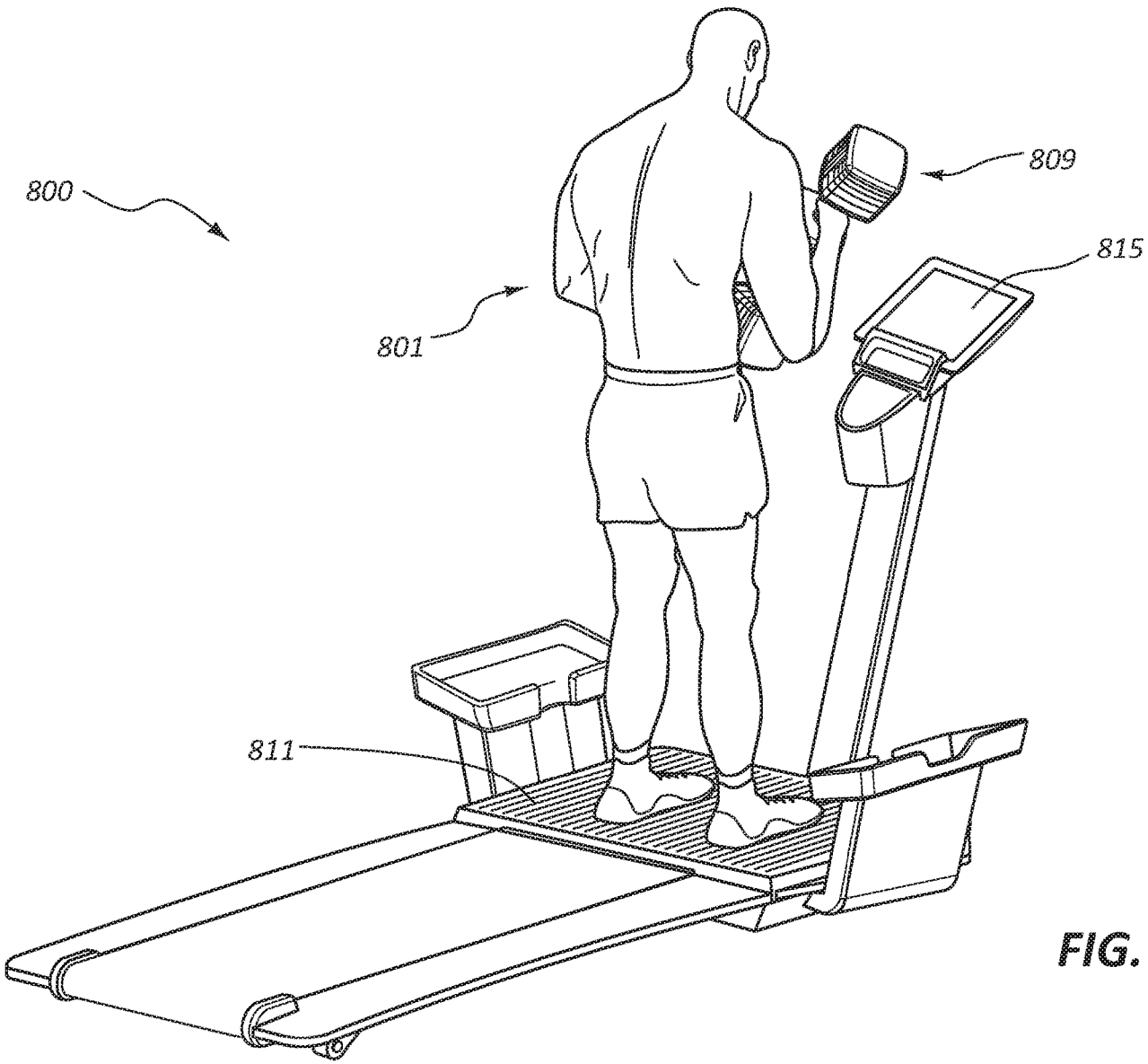
FIG. 9 illustrates a perspective view of an example of a treadmill in accordance with the present disclosure.

FIG. 9 depicts an example of a user 801 performing an anaerobic workout with the free weights (e.g., dumbbell 809) on the weight scale 811. In this situation, the fluctuation of the weight scale's measurements while the user performs lifts with the free weights is used by the repetition counter to determine how many lifts the user has performed. In this example, the amount of weight lifted by the user 801 is depicted in the console 815.

Figure 10:
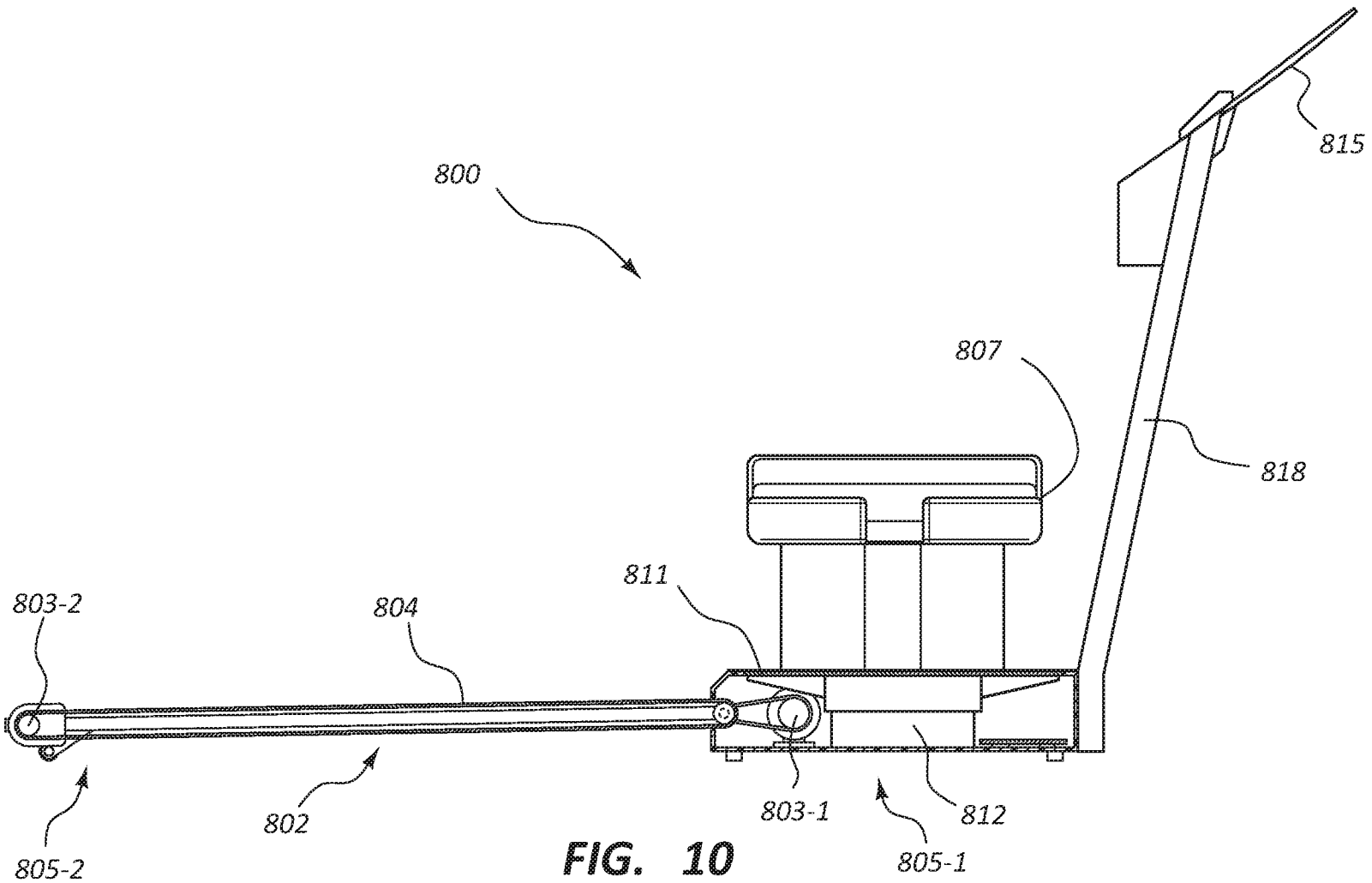
FIG. 10 illustrates a cross sectional view of an example of a treadmill in accordance with the present disclosure.

FIG. 10 depicts a cross sectional view of a treadmill 800. In this example, the treadmill 800 includes a deck 802 with a first pulley 803-1 in a first portion 805-1 of the deck 802 and a second pulley 803-2 in a second portion 805-2 of the deck. A tread belt 804 surrounds the first pulley 803-1 and the second pulley 803-2. A motor 812 drives the first pulley 803-1 to move the tread belt 804. A weight scale 811 is positioned over the motor 812. A rack 807 is attached to the deck 802 adjacent to the weight scale 811. An upright portion 818 of the treadmill 800 is attached to the deck 802, and a console 815 is attached to the upright portion 818.

Figure 11:
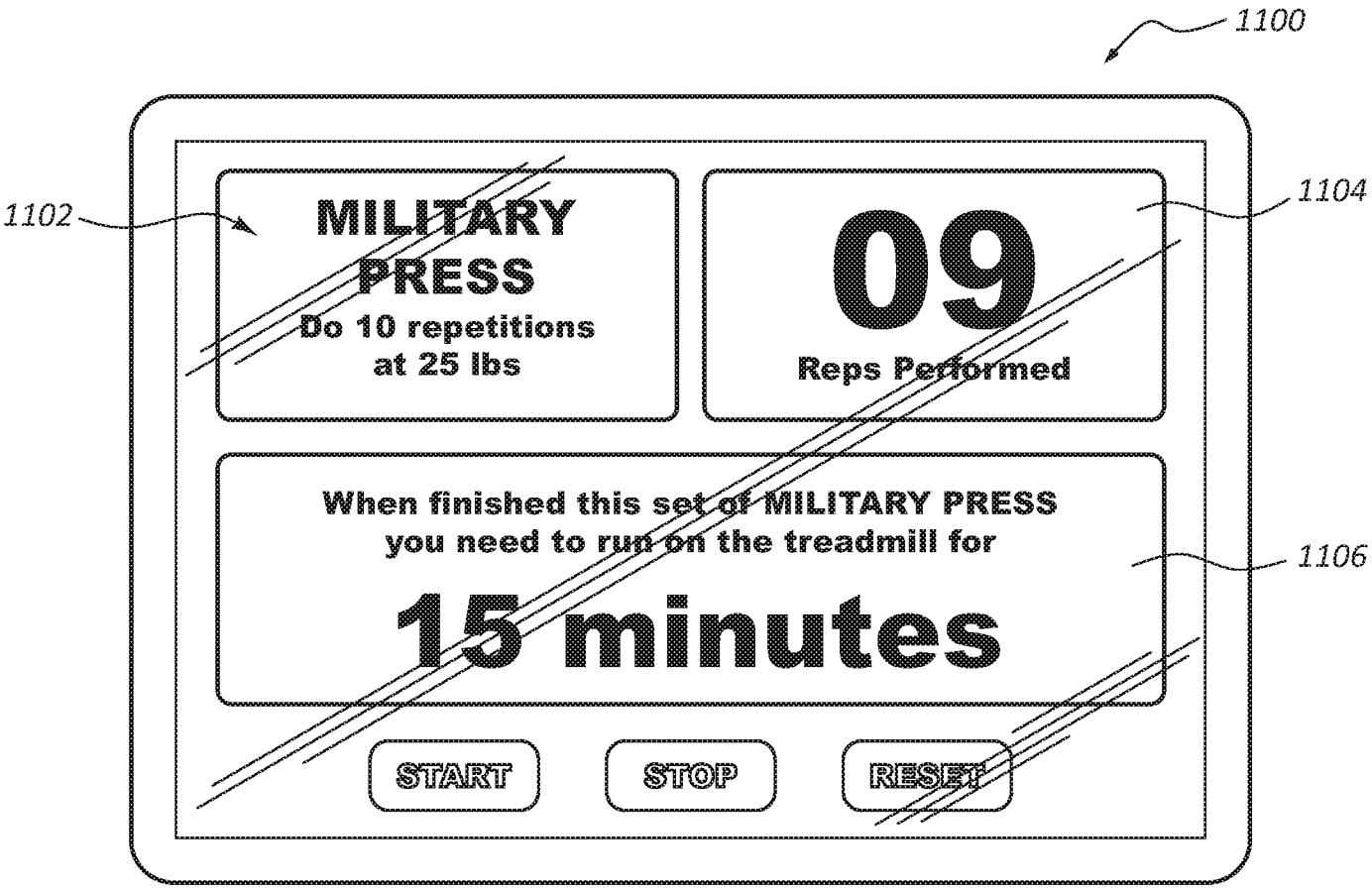
FIG. 11 illustrates a view of an example of display incorporated into an exercise device in accordance with the present disclosure.

FIG. 11 depicts an example of a display 1100 incorporated into a console of an exercise device. The exercise device may be like the exercise device depicted in the other figures that incorporate a weight scale. In this example, the display includes instructions 1102 to perform a certain type of lift, including the weight amount to be lifted and the number of repetitions. The display 1100 also includes a repetition counter 1104, which presents the number of repetitions that the user has already performed. The display 1100 also includes instructions 1106 for what the user is to do after the anaerobic exercise is completed. In this case, the instructions includes running on the treadmill for 15 minutes.

Figure 12:
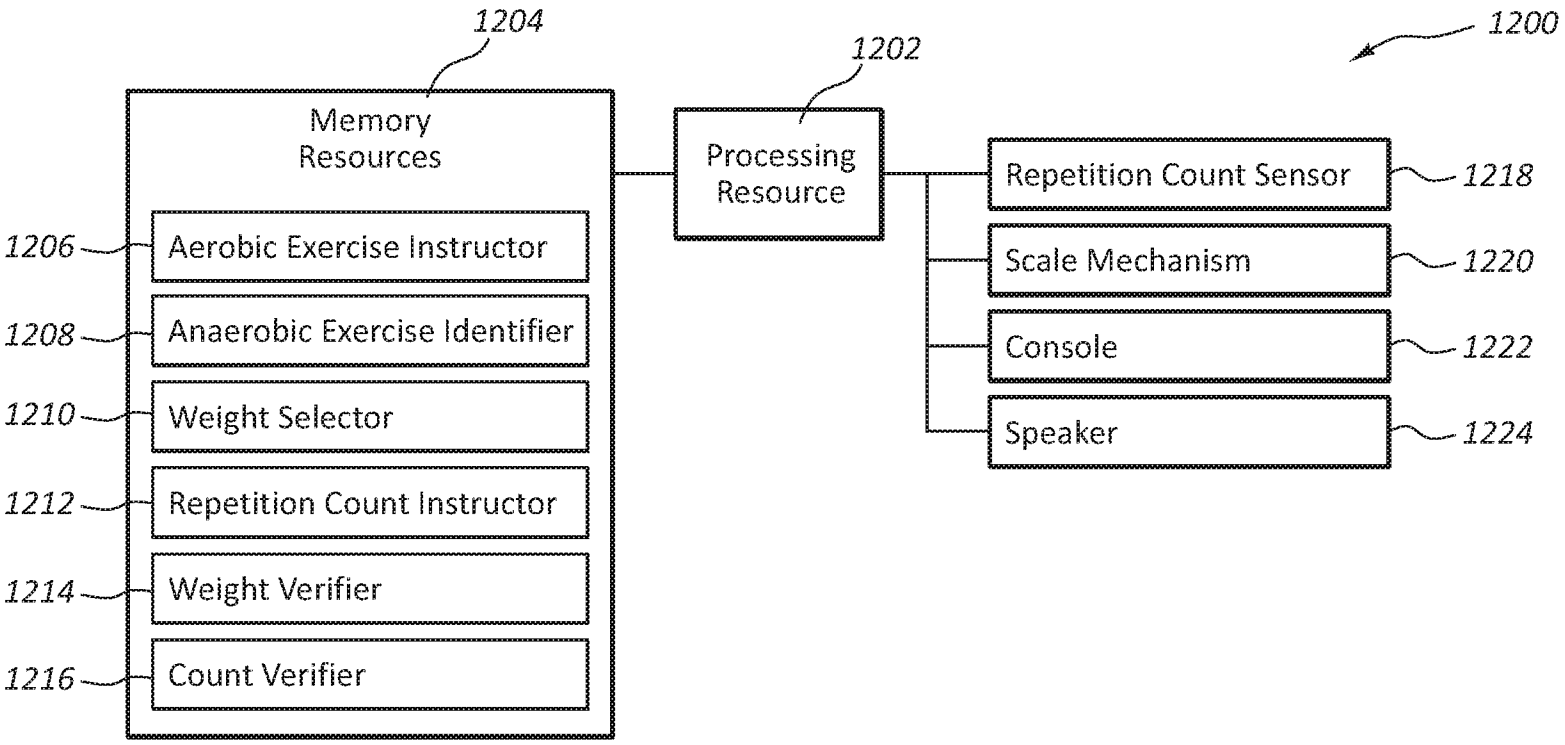
FIG. 12 illustrates a perspective view of an instruction system incorporated into an exercise device in accordance with the present disclosure.

FIG. 12 depicts an example of an instruction system 1200. In this example, the instruction system 1200 includes processing resources 1202 and memory resources 1204. The memory resources 1204 may cause the processing resources 1202 to carry out functions programmed in the memory resources 1204. In this example, the memory resources 1204 include an aerobic exercise instructor 1206, an anaerobic exercise instructor 1208, a weight selector 1210, a repetition count instructor 1212, a weight verifier 1214, and a count verifier 1216. Further, the processing resources 1202 may be in communication with a repetition count sensor 1218, a scale mechanism 1220, a console 1222, a speaker 1224, or combinations thereof.

GENERAL DESCRIPTION

In general, the invention disclosed herein may provide an user with a treadmill that has several advantages over conventional treadmills. The treadmill may include a running deck that has first pulley and a second pulley. A tread belt may surround the first and second pulley. A motor can be attached to either the first or the second pulley so that as the motor rotates its shaft, the connected pulley also rotates which drives movement of the tread belt. In those examples where the treadmill includes just a single motor, the movement of the tread belt drives movement of the other pulley that is not connected to the motor.

The platform may have a length along its longest dimension and a width that is transverse the length. The platform's edges along both the width and the length have a wide section on which the user can stand. These wide sections may include foot grips. The wide sections may be incorporated in the front of the platform, the rear of the platform, and both sides of the platform. These wide sections are constructed to have a strength that is sufficient to hold the user's weight, even when the user is performing dynamic exercises/movements on the wide sections.

Multiple posts may be removably connected to the platform. For example, a first and second post may be removably connected to a single side of the platform. In some examples, the posts are inserted into a recess defined in the platform's top surface. A stab connection between the base end of the post and the recess allows for quick and easy assembly. In some cases, the stab connection may include an alignment features incorporated into the base end of the post, such as a protrusion or trough that interlocks with a corresponding alignment feature in the recess. The alignment features may force the posts to be inserted in just a single orientation which causes the connectors attached to the top end of the posts to be oriented in a desired orientation. For example, the top ends of the first and second posts may include eyes or another type of opening that can receive a rail. In this example, the alignment features may align the eyes of the first and second posts so that the rail can be inserted through both the eyes. Thus, the first and second posts can collectively support a rail on one side of the treadmill. This rail may be inserted through the eyes of the posts' connectors for quick and easy attachment. In some cases, the location features may be incorporated into the rail which forces the rail to be inserted only so far into the post's eyes so that during assembly, the rails come to a stop in the desired locations.

Similarly, a third and a fourth post may be removably connected to the treadmill's platform on the other side of the gap. The third and the fourth posts may also connect a second rail on the other side of the gap. The first and second rails may be positioned adjacent to the gap and within a convenient arm's reach for a user who is walking or otherwise performing a type of exercise on the tread belt.

The base end of the posts may be held in place in the recess through a compression fit. In other examples, the base end of the posts are bolted to the platform. In yet other examples, the base end of the posts includes thread forms that are complementary to thread forms formed in the recesses and the posts' base end and the recess are threadly connected.

In some cases, the treadmill may be used to do dance moves, dance routines, barre exercises, other types of movements, or combinations thereof. In some cases, the rails may be vertically adjustable so that users of different heights may perform barre exercises, other types of movements, or combinations thereof. The portion of the platform underneath and adjacent to the rails may include a foot grip to assist the user when performing these movements.

In those situations where the treadmill is being used to perform dancing movements, one of the rails and its associated posts may be removed from the treadmill. The user may prefer to have the rails and posts in place while the user is performing an aerobic exercise on the treadmill. But, in some examples, all of the rails and posts are removed when the user executes an aerobic workout on the running deck.

The first post may be connected to the first rail with an offset connector. A first end of the offset connector may include an eye defined by the first end. The eye may be sized to receive a cross section of the first rail. In this example, the first rail may be slid through the eye. In some examples, the friction between an inside surface of the eye and the outside surface of the first rail may be sufficient to minimize movement between the first rail and the offset connector.

A second end of the offset connector defines a hole that is sized to be positioned over a receptacle defined in a top end of the first post. In this example, a screw is fitted through the hole of the offset connector and into the top end of the first post. The screw may be drawn tightly into the top end's receptacle by twisting the screw in a circular motion. The friction between the screw's outside surface and the receptacle's inside surface may be sufficient to hold the weight of the offset connector and the first rail. One advantage of the offset connector is to provide space superjacent the screw so that the screw is accessible to the user and the screw can be hand tightened.

While this example has been described with a specific structure for connecting the rails to the posts, any appropriate mechanism for connecting the rails to the post may be used in accordance with the principles described herein. For example, the rails may be integrally formed with the posts so that the posts and the rails are installed into the platform as a single unit. In other examples, the rails may snap into the posts. In yet an additional example, the rail may be held in place with magnets, adhesives, latches, straps, other mechanisms, or combinations thereof.

Also, even though the examples above have described the connection between the base end of the posts and the platform as a stab connection, any appropriate type of connection may be used in accordance with the present disclosure. For example, the posts may be screwed into place, wedged into place, bolted into place, or otherwise connected to the platform.

In some embodiments, when the posts are removed from the platform, recesses from which the posts were removed are exposed. In some cases, pop-up covers may be urged upward when the posts are removed. These pop-up covers may occupy a space defined by the recesses. The pop-up covers may be spring loaded so that the move up in the absence of a load (e.g. when the posts are removed from the recess) and move downward out of the way when a sufficient load is applied (e.g. when the post is inserted into the recess). The pop-up cover can prevent objects from getting placed in the recess that could interfere with inserting the posts. In other examples, the pop-up covers may be pneumatically, electrically, or hydraulically controlled. Further, the pop-up covers may be controlled with another type of mechanical mechanism other than a spring.

In some instances, the pop-up cover hides an electrical contact that is positioned in a side of either of the first recess or the second recess when the pop-up cover is urged upwards. In some instances, as an end of the first and/or second post is inserted back into the respective recess, the pop-up cover is displaced by the load applied from the insertion of the post. An electrically conductive portion of the end of the post may make direct or indirect contact with the electrical contact in the recess to establish an electrical connection. In these instances, electrical loads associated with the posts and/or rails may receive electrical power when the posts are inserted. For example, a control input may be incorporated into the rails and/or posts that generate an electrical load to operate.

The platform may be wider than conventional treadmill decks. For example, the platform may be at least 2.5 feet wide. In some instances, the platform may be up to six feet wide. When the platform is over 2.5 feet wide, shocks that are conventionally used in treadmills to cushion the user's impacts may not be used while still providing a sufficient amount of cushion for the user. This wider dimension allows for the platform to deflect as the user's feet impact the running deck. Thus, the impacts can be absorbed over a greater portion of the platform Further, the platform may also have a lower profile than conventional treadmill decks. For example, the platform may have a profile of less than six inches. In some examples, the platform has a profile that is less than five inches. In yet other examples, the profile is less than four inches. In even yet additional examples, the profile is less than three inches. Unlike conventional treadmills that include legs that space the underside of the treadmill off of the ground, in this example the underside of the platform rests directly on the support surface to keep the top surface of the treadmill closer to the support surface.

A low profile treadmill may assist those doing dance routines or other types of exercises that may involve getting on and off of the treadmill. Further, a low profile treadmill that is just a few inches off of the support surface may reduce the difficulty that elderly users or less agile users have getting on and off of the treadmill.

To assist with getting on and off of the treadmill, the portions of the platform around the gap may include foot grips. In some examples, the foot grips are just located on the sides of the platform that are aligned with the platform's length. In other examples, the foot grips are included in those parts of the platform that cover the front pulley and/or the back pulley.

In some examples, the platform may include sensors that identify where the user is standing. These sensors may indicate whether the user has stepped off of the tread belt onto the platform. In this example, the treadmill may reduce or eliminate the speed of the tread belt when the user is no longer standing on the tread belt. This sensor may be a load cell incorporated into any portion of the platform. In other examples, the sensor is a strain gauge, a magnetic sensor, a pressure chamber, another type of sensor, or combinations thereof that may be incorporated into the platform to detect when the user is on the platform. In some examples, the load drawn from the motor may indicate when no one is standing, walking, running, or otherwise on the tread belt. In this situation, the treadmill may power down the tread belt in response to determining that the tread belt is not being used. In yet other examples, other types of weight detecting sensors may be incorporated into the tread belt assembly to determine when the user is on the tread belt. In even further examples, an optical sensor, such as a camera, an infrared sensor, a distance sensor, or another type of sensor may be used to determine whether the user is on the tread belt or not. In other examples when the sensors are pressure plates, the plates may be just incorporated into an edge of the platform.

To enable a low profile platform as described above, the pulleys, tread belt, motor, and flywheel are thinner than the platform. To provide sufficient horse power to drive the movement of the pulleys and tread belt with components that thin, multiple motors may be used. In other examples, just a single motor is used to drive the movement of the pulleys and tread belt.

Further, the flywheel incorporated into the thin platform has a diameter that is shorter than conventional flywheels. In flywheels, the rotary energy that is stored during the rotation of the flywheel is in the flywheel's outer circumference, which motivates one of ordinary skill in the art to increase the flywheel's circumference to store more energy while reducing the flywheel's cross sectional thickness. Thus, the flywheel's outer diameter is greater than the flywheel's cross sectional thickness. In contrast, some of the example of the present invention include a flywheel with a cross sectional thickness that is greater than its outer diameter. With the cross sectional thickness being the longest dimension of the flywheel, the cross sectional thickness becomes the flywheel's length. In this example, the flywheel includes a rotational axis, a flywheel length aligned with the rotational axis, an outer diameter transverse the flywheel length where the flywheel length is greater than the outer diameter.

In some cases, the length of the flywheel is at least three inches. In another example, the length of the flywheel is at least four inches. In additional examples, the length of the flywheel is at least five inches. In yet another example, the length of the flywheel is at least six inches. In an even additional example, the length of the flywheel is at least seven inches.

The flywheel may be supported with a support connected to the platform on a first side of the flywheel and on a second side of the flywheel. In other examples, either of the flywheel's end may be supported by other components that are at least fixed with respect to the platform. A bearing assembly may be used on each end of the flywheel to support the flywheel from sagging.

The console may be incorporated into the treadmill's platform. In some cases, the platform includes a display screen integrated into the platform's top surface. This display screen may be used to display information associated with the workout, with the user, with local news, with other types of information, or combinations thereof. In some examples, the treadmill's operational parameters can be presented in the display screen. The display screen may be made of any appropriate type of material that can withstand a user standing on it. This material may include Kevlar® or another type of material.

In some examples, the console is in communication with other sensors incorporated into the treadmill. The console and these sensors may be hardwired or in wireless communication. In some examples, a hear rate monitor is incorporated into the rails. An electrically conductive medium carries the signal from a heart rate monitor pad incorporated into the rail to the connector that attaches the rail to the post. The connector may include an electrically conductive material that connects the electrically conductive media of the rail with an electrically conductive media in the post. The electrically conductive media of the post may make an electrical connection with an electrical contact in the recess where the post is connected to the platform. The platform may be wired to carry the signal to a processor for interpreting the signal to understand the user's heart rate. This heart rate may be displayed in the display screen.

In another example, the rail includes at least one input mechanism that can be used to change an operational parameter of the treadmill, change the display screen's view, send a message, perform another task, or combinations thereof. The rail may be electrically connected to the platform as explained above or alternatively, the rail may be in wireless communication with the platform, processor, and/or display screen.

Further, the platform may also incorporate at least one input mechanism. The input mechanism may be used to change an operational parameter of the treadmill, change the display screen's view, send a message, perform another task, or combinations thereof.

The treadmill may also be in communication with a remote device over a network, such as the internet. The user may access the records of his or her exercise history, previous workouts, exercise recommendation, personal information, or combinations thereof. The remote device may record the workout information and/or the physiological information associated with the workout. An example of a user program that may be compatible with the principles described herein can be found at www.ifit.com, which is administered through Icon Health and Fitness, Inc. located in Logan, Utah, U.S.A.

In some cases, a free weight rack may be incorporated into the treadmill. In this example, the free weight rack may have a first portion incorporated into a first side of the treadmill and a second portion incorporated into a second side of the treadmill. Each of the portions of the free weight rack may position the free weights within a convenient reach of each of the user's hands. Thus, the free weights may be accessible to the user when the user is on the exercise deck.

For purposes of this disclosure, the term "free weight" refers broadly to free weights that are intended to be used to execute lifts associated with strength training. In some cases, the free weights may be intended to be held in a single hand where free weights for a first hand are positioned in the first portion 718 of the free weight rack 716, and free weights intended for the second hand are positioned in the second portion 722 of the free weight rack 716. These free weights may include dumbbells, kettle balls, balls, adjustable dumbbells, weight plates, Bulgarian bags, other types of weighted bags, barbells, curl bars, other types of free weights, or combinations thereof.

In some cases, the user can work out on the portion of the exercise deck that includes the tread belt. In this example, the user may desire to mix up the anaerobic exercise and aerobic exercise portions of his or her workout. During the anaerobic portions of the workout, the tread belt may be stopped while the user performs the free weight exercises. When the anaerobic portion of the workout is completed, the user may resume the operation of the tread belt to perform an aerobic portion of the workout. In other examples, the user may want to use the free weights while the tread belt is in operation. For example, the user may want to carry dumbbells during a run.

In other examples, the treadmill incorporates a separate area on the exercise deck where the user can perform exercises with the free weights. In some cases, this free weight area may be in the front end of the treadmill proximate the treadmill's upright portion. A console supported by the upright portion can provide information about the user's workout such as the time, distance, and speed at which the user executed the aerobic portions and the anaerobic portions of the workout.

In some cases, the free weight area may include a weight scale. The weight scale may be large enough to allow the user to stand and/or exercise on the weight scale. This type of treadmill may allow the user to alternate between performing exercises on the tread belt and performing exercises on the weight scale. One advantage to working out on the weight scale is that as the user performs certain types of exercises, like thrusting free weights over his head, the load felt by the weight scale changes. Detecting this change can be used to determine when and if the user actually performed the overhead lift. For example, in situations where the dumbbells are thrust over the user's head, the scale may measure an increased amount of weight. The processing resources in communication with the weight scale may associate a time stamp with the measured increase. Thus, the processing resources can determine statistics about the user's workout (e.g. how long the user executed the workout, how long between each repetition, start times, end times, and so forth).

The weight scale can also determine how much weight the user is using during the workout. For example, the weight scale can determine the weight of the user when the user is standing on the scale without holding weights. When the user picks up free weights, the weight scale can subtract the user's body weight from the total weight being measured. The difference between the total weight and the user's body weight can be assumed to be the weight amount the user is holding.

Exercising on the scale can provide inputs for determining how many repetitions the user performed. For example, the weight scale may recognize weight fluctuation patterns that are characteristic of the user lifting or lowering free weights. As these patterns are recognized, the weight scale may cause a repetition counter to increment by one when a lift pattern is recognized.

The weight scale may include any appropriate type of measuring mechanism. In some examples, the weight scale includes a piezoelectric material that changes its electrical properties in response to a mechanical load. In other examples, the weight scale may include a magnetostrictive material that changes its magnetic properties in response the mechanical load. In yet other examples, the weight scale may also include a spring mechanism, a strain gauge, a hydraulic mechanism, a pneumatic mechanism, another type of measuring mechanism, or combinations thereof.

In some cases, the tread belt passes over the region of the treadmill deck that contains the weight scale. In this example, the treadmill can determine when the user is holding weight while standing on the tread belt like in situations where the user is carrying free weights during a walk or run. In response to determining that the user is carrying free weights during a walk or run, the treadmill can increase the calorie burn count.

In some situations, the treadmill guides the user with a programmed workout. In some cases, the programmed workout alters the tread belt's speed, the incline of the deck, and other factors affecting the aerobic portion of the workout. Additionally, the programmed workout may include anaerobic portions as well. In these instances, the programmed workout may instruct the user to perform certain types of lifts with the free weights. In some cases, the programmed workout may select the amount of weight that the user is to lift. In embodiments where the free weight rack includes an adjustable dumbbell, the treadmill may cause the adjustable dumbbell to select the amount of weight prescribed by the programmed workout. In other instances, the treadmill may allow the user to select the amount of weight to lift even if the programmed workout instructs the user to lift a predetermined amount.

The predetermined weight amount recommended in the programmed workout may be based on information about the user. This information may be derived from history compiled with fitness trackers, previous workouts on the treadmill, age information, height information, body composition information, gender information, other types of personal information, or combinations thereof. In some instances, the treadmill is in communication with a remote computing device that contains a user profile detailing fitness information about the user. The treadmill or a remote computing device may also take into consideration the user's fitness goals when selecting the type of lifts to perform, the amount of weight to perform with the lifts, and the number of repetitions.

The weight scale can be used to determine if the user selected the recommended weight amount. In those situations where the user selected a different weight amount than the recommended amount, the programmed workout can alter an aspect of the workout. For example, if the user selected a weight amount that is heavier than the recommended amount, the programmed workout can reduce the number of repetitions that the user is instructed to lift. Further, the calorie burn count can also be adjustable based on the weight amount that the user actually selects instead of the weight amount instructed by the programmed workout.

The weight scale can also be used to verify that the user performs the number of recommended lifts. In this example, the weight scale can cause a repetition counter to increment by one when the weight scale detects a weight fluctuation pattern characteristic of performing a lift. In some examples, a separate repetition counter is used to determine the number of repetitions performed by the user. For example, an optical camera can be incorporated into the treadmill's upright structure. The optical camera can record and analyze information to determine the number of lifts performed by the user and, in some instances, whether the user performed the type of lift instructed by the programmed workout.

In some cases, the programmed workout's instructions can be presented to the user through a display in the console. The programmed workout can present the number of lifts to perform, the type of lifts to perform, the next type of exercise to perform, and so forth. In some case, the display screen can instruct the user on how to perform the lift. For instance, the programmed workout may instruct the user to perform negatives by lifting up quickly and lowering the weight slowly, or the programmed workout may instruct the user to perform the same type of lift by lifting up and lowering the weight at the same rate. In other examples, a speaker may be used to audibly instruct the user about the programmed workout.

Information relating to both the anaerobic and aerobic portions of the workout can be present to the user. For instance, the repetition count may be presented in the display, the calories burned during the workout may be presented in the display, the user's heart rate or other physiological parameters be presented in the display, and so forth.

In some case, the treadmill is in communication with a remote device, and the information recorded about the workout is sent to the remote device. In one instance, the information is sent to the user's mobile device and the user follows the workout with his or her mobile device.

The instruction system for instruction the user about the workout may include a combination of hardware and programmed instructions for executing the functions of the instruction system. The instruction system may include processing resources that are in communication with memory resources. Processing resources include at least one processor and other resources used to process the programmed instructions. As described herein, the memory resources may represent generally any memory capable of storing data such as programmed instructions or data structures used by the instruction system.

The processing resources may include I/O resources that are capable of being in communication with a remote device that stores user information, workout history, external resources, databases, or combinations thereof. The remote device may be a mobile device, a cloud based device, a computing device, another type of device, or combinations thereof. In some examples, the instruction system communicates with the remote device through a mobile device which relays communications between the instruction system and the remote device. In other examples, the mobile device has access to information about the user. The remote device may collect information about the user throughout the day, such as tracking calories, exercise, activity level, sleep, other types of information, or combination thereof.

The remote device may execute a program that can provide useful information to the instruction system. An example of a program that may be compatible with the principles described herein includes the iFit program which is available through www.ifit.com identified above. An example of a program that may be compatible with the principles described in this disclosure is described in U.S. Pat. No. 7,980,996 issued to Paul Hickman. U.S. Pat. No. 7,980,996 is herein incorporated by reference for all that it discloses. In some examples, user information accessible through the remote device includes the user's age, gender, body composition, height, weight, health conditions, other types of information, or combinations thereof.

The processing resources, memory resources, and remote devices may communicate over any appropriate network and/or protocol through the input/output resources. In some examples, the input/output resources includes a transmitter, a receiver, a transceiver, or another communication device for wired and/or wireless communications. For example, these devices may be capable of communicating using the ZigBee protocol, Z-Wave protocol, BlueTooth protocol, Wi-Fi protocol, Global System for Mobile Communications (GSM) standard, another standard, or combinations thereof. In other examples, the user can directly input some information into the instruction system through a digital input/ output mechanism, a mechanical input/output mechanism, another type of mechanism, or combinations thereof.

The memory resources may include a computer readable storage medium that contains computer readable program code to cause tasks to be executed by the processing resources. The computer readable storage medium may be a tangible and/or non-transitory storage medium. The computer readable storage medium may be any appropriate storage medium that is not a transmission storage medium. A non-exhaustive list of computer readable storage medium types includes non-volatile memory, volatile memory, random access memory, write only memory, flash memory, electrically erasable program read only memory, magnetic based memory, other types of memory, or combinations thereof.

The memory resources may include an aerobic exercise instructor that represents programmed instructions that, when executed, cause the processing resources to control the aerobic portion of the user's workout. The aerobic exercise may include, but is not limited to, walking, running, shuffling, skipping, biking, jumping, or otherwise moving while the tread belt is in operation. The aerobic exercise instructor may control the speed of the tread belt based on the user's heart rate or other physiological readings, the user's goals, programmed workouts, inputs from the user, or combinations thereof.

The memory resources may also include an anaerobic exercise instructor that represents programmed instructions that, when executed, cause the processing resources to control the anaerobic portions of the user's workout. The anaerobic exercise instructor may instruct the user to perform lifts, perform a number of repetitions, perform a type of lift, perform other aspects of the anaerobic portion of the workout, perform other aspects of the workout, or combinations thereof.

The memory resources may also include a weight selector that represents programmed instructions that, when executed, cause the processing resources to select the amount of weight to lift. In one embodiment, the free weights include an adjustable dumbbell, and a selector is incorporated into the rack. The selector adjusts the dumbbell so that the desired amount of weight is automatically attached to the dumbbell's handle, and the user does not have to make the adjustment manually.

The repetition count instructor represents programmed instructions that, when executed, cause the processing resources to instruct the user to perform a number of lifts. The lift number may be presented to the user through a display, through a speaker, another mechanism, or combinations thereof.

The weight verifier represents programmed instructions that, when executed, cause the processing resources to verify that the user is lifting the weight. In some cases, the weight verifier also verifies that the user is lifting the amount of weight instructed by the instruction system.

The counter verifier represents programmed instructions that, when executed, cause the processing resources to verify that the user is performing the instructed number of lifts. This count verification may be based on images captured with an optical sensor, the fluctuations measured at the weight scale, another type of sensor, or combinations thereof. The count verification may be presented in a console or display integrated into the treadmill, a mobile device in communication with the treadmill, a remote device in communication with the treadmill, or combinations thereof.

Further, the memory resources may be part of an installation package. In response to installing the installation package, the programmed instructions of the memory resources may be downloaded from the installation package's source, such as a portable medium, a server, a remote network location, another location, or combinations thereof. Portable memory media that are compatible with the principles described herein include DVDs, CDs, flash memory, portable disks, magnetic disks, optical disks, other forms of portable memory, or combinations thereof. In other examples, the program instructions are already installed. Here, the memory resources can include integrated memory such as a hard drive, a solid state hard drive, or the like.

In some examples, the processing resources and the memory resources are located within the treadmill, the adjustable dumbbell, the mobile device, an external device, another type of device, or combinations thereof. The memory resources may be part of any of these device's main memory, caches, registers, non-volatile memory, or elsewhere in their memory hierarchy. Alternatively, the memory resources may be in communication with the processing resources over a network. Further, data structures, such as libraries or databases containing user and/or workout information, may be accessed from a remote location over a network connection while the programmed instructions are located locally.

What is claimed is:

1. A treadmill, comprising:

a deck;

a first pulley disposed in a first portion of the deck;

a second pulley disposed in a second portion of the deck;

a tread belt surrounding the first pulley and the second pulley;

a motor in mechanical communication with at least one of the first pulley or the second pulley;

a cover over the motor; and a scale mechanism incorporated into the cover over the motor;

a processor and a memory, wherein the processor is in communication with the scale mechanism;

a display in communication with the processor, wherein the memory includes programmed instructions that, when executed, cause the processor to:

display a weight of a user; and determine whether the user is holding a free weight.

2. The treadmill of claim 1, wherein determining whether the user is holding the free weight includes measuring an increase with the scale mechanism.

3. The treadmill of claim 1, wherein the programmed instructions, when executed, further cause the processor to instruct the user to select the free weight if it is determined that the user is not holding the free weight.

4. The treadmill of claim 3, wherein the programmed instructions, when executed, further cause the processor to instruct the user to perform an exercise with the selected free weight.

5. The treadmill of claim 3, wherein the programmed instructions, when executed, further cause the processor to instruct the user to perform a pre-determined repetition count with the selected free weight.

6. The treadmill of claim 3, wherein the programmed instructions, when executed, further cause the processor to verify that the user selected the selected free weight by measuring an increase with the scale mechanism.

7. The treadmill of claim 1, further including a free weight rack connected to the deck.

8. The treadmill of claim 1, wherein the free weight includes a first free weight and a second free weight.

9. The treadmill of claim 8, wherein one or more of the first free weight and the second free weight include one or more of a kettlebell and a dumbbell.

10. The treadmill of claim 8, wherein determining whether the user is holding the free weight includes measuring an increase with the scale mechanism to determine a difference between a total weight and a user's body weight to determine whether the user is holding the first free weight or the second free weight.

11. The treadmill of claim 1, wherein the scale mechanism is configured for determining how many repetitions the user performed with the free weight.

12. The treadmill of claim 11, wherein the scale mechanism is configured for determining how many repetitions the user performed with the free weight by recognizing weight fluctuation patterns.

13. The treadmill of claim 1, wherein the free weight includes a plurality of free weights, and wherein the scale mechanism is configured for determining how many repetitions the user performed with the plurality of free weights.

14. A treadmill, comprising:

a deck;

a first pulley disposed in a first portion of the deck;

a second pulley disposed in a second portion of the deck;

a tread belt surrounding the first pulley and the second pulley;

a motor in mechanical communication with at least one of the first pulley or the second pulley;

a cover over the motor; and a scale mechanism incorporated into the cover over the motor;

a processor and a memory, wherein the processor is in communication with the scale mechanism;

a display in communication with the processor, wherein the memory includes programmed instructions that, when executed, cause the processor to:

display a weight of the user; and instruct a user to select a free weight.

15. The treadmill of claim 14, wherein the programmed instructions, when executed, further cause the processor to determine whether the user is holding the selected free weight.

16. The treadmill of claim 14, wherein the programmed instructions, when executed, further cause the processor to instruct the user to perform an exercise with the selected free weight.

17. The treadmill of claim 14, wherein the programmed instructions, when executed, further cause the processor to instruct the user to perform a pre-determined repetition count with the selected free weight.

18. The treadmill of claim 14, wherein the programmed instructions, when executed, further cause the processor to verify that the user selected the selected free weight by measuring an increase with the scale mechanism.

19. The treadmill of claim 14, further including a free weight rack connected to the deck.

* * * * *